US007475959B2

(12) United States Patent
Nagashima

(10) Patent No.: US 7,475,959 B2
(45) Date of Patent: Jan. 13, 2009

(54) LIQUID EJECTION APPARATUS AND LIQUID EJECTION HEAD RESTORING METHOD

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 403 days.

(21) Appl. No.: 11/230,820

(22) Filed: Sep. 21, 2005

(65) Prior Publication Data

US 2006/0061624 A1 Mar. 23, 2006

(30) Foreign Application Priority Data

Sep. 22, 2004 (JP) ..... 2004-275853

(51) Int. Cl.
*B41J 29/393* (2006.01)

(52) U.S. Cl. ..... 347/19; 347/14; 347/67

(58) Field of Classification Search ..... 347/10, 347/14, 19, 67, 68
See application file for complete search history.

(56) References Cited

U.S. PATENT DOCUMENTS

| | | | | |
|---|---|---|---|---|
| 5,617,516 | A * | 4/1997 | Barton | 358/1.14 |
| 5,757,392 | A * | 5/1998 | Zhang | 347/14 |
| 5,880,751 | A | 3/1999 | Nishikori et al. | |
| 6,109,716 | A | 8/2000 | Takahashi | |
| 6,224,182 | B1 | 5/2001 | Nagoshi et al. | |
| 2001/0007457 | A1 | 7/2001 | Nagoshi et al. | |
| 2001/0024583 | A1* | 9/2001 | Kawatoko | 400/74 |
| 2002/0024547 | A1 | 2/2002 | Miyakoshi | |

FOREIGN PATENT DOCUMENTS

| | | | |
|---|---|---|---|
| JP | 7-52408 | A | 2/1995 |
| JP | 7-132592 | A | 5/1995 |
| JP | 7-323552 | A | 12/1995 |
| JP | 8-150713 | A | 6/1996 |
| JP | 10-272766 | A | 10/1998 |
| JP | 11-99646 | A | 4/1999 |
| JP | 2001-239658 | A | 9/2001 |
| JP | 2002-29037 | A | 1/2002 |
| JP | 2002-137377 | A | 5/2002 |
| JP | 2002-205397 | A | 7/2002 |
| JP | 2003-205623 | * | 7/2003 |
| JP | 2003-205623 | A | 7/2003 |
| JP | 3495898 | B2 | 11/2003 |

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The liquid ejection apparatus comprises: a liquid ejection head including an ejection port surface on which a plurality of ejection ports for ejecting a liquid toward a recording medium are arranged; a drive condition selection device which selects at least one of drive conditions for the liquid ejection head in order to eject the liquid from the ejection ports, the drive conditions including a first drive condition in which individual performance variations among the liquid droplet ejection heads in relation to ejection performance are reflected, and a second drive condition in which ambient environmental changes are reflected on the first drive condition; and an ejection failure determination device which performs determination of ejection state of the liquid, wherein, if the liquid ejection head is driven under the second drive condition during normal ejection, then the liquid ejection head is driven during the determination of the ejection state under a drive condition in which an ejection performance is equal to or less than that of the first drive condition.

12 Claims, 22 Drawing Sheets

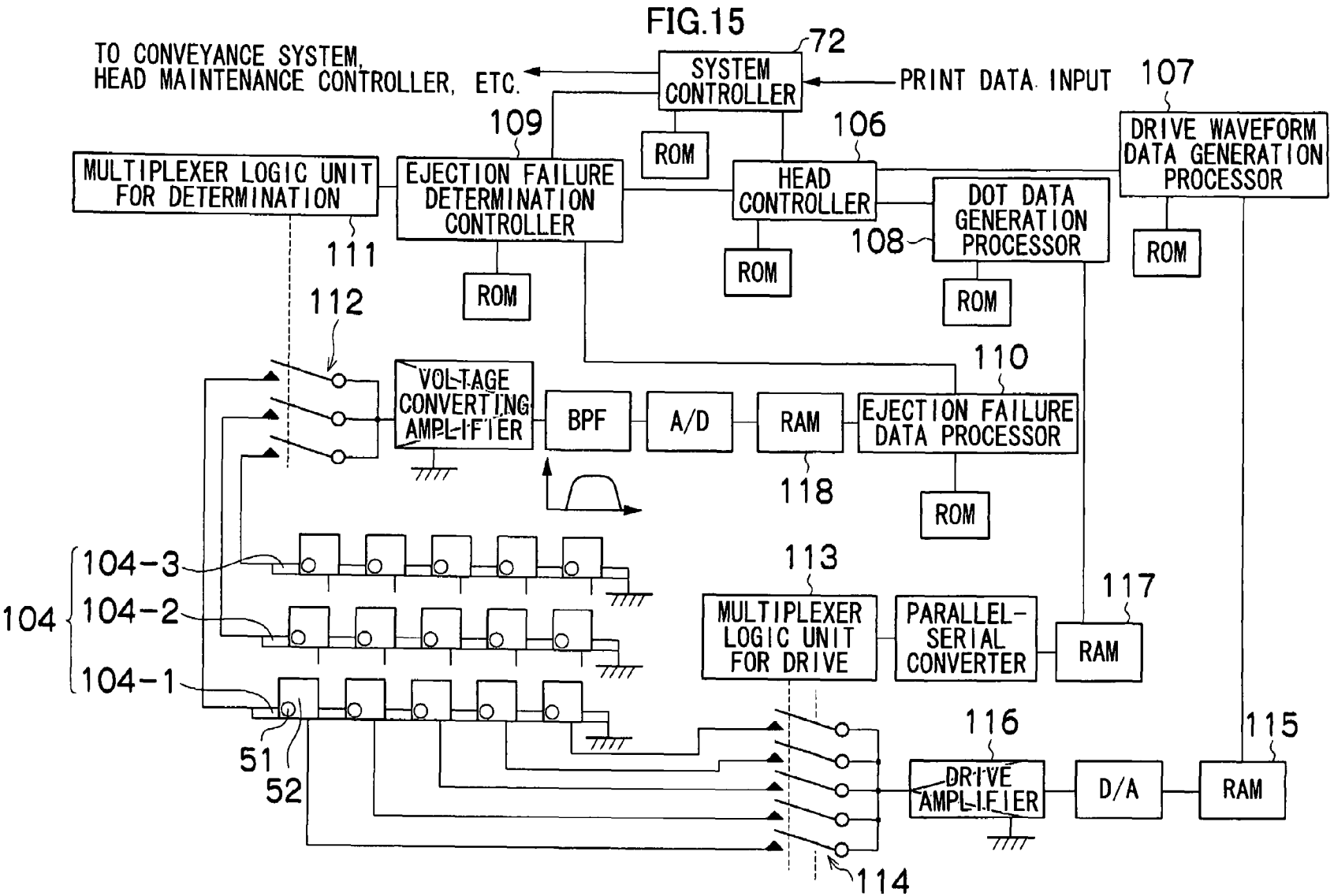
FIG.15
PRINT DATA INPUT
TO CONVEYANCE SYSTEM, HEAD MAINTENANCE CONTROLLER, ETC.
SYSTEM CONTROLLER
72
ROM
HEAD CONTROLLER
106
ROM
DRIVE WAVEFORM DATA GENERATION PROCESSOR
107
ROM
DOT DATA GENERATION PROCESSOR
108
ROM
EJECTION FAILURE DETERMINATION CONTROLLER
109
ROM
EJECTION FAILURE DATA PROCESSOR
110
ROM
MULTIPLEXER LOGIC UNIT FOR DETERMINATION
111
112
VOLTAGE CONVERTING AMPLIFIER
BPF
A/D
RAM
118
MULTIPLEXER LOGIC UNIT FOR DRIVE
113
PARALLEL-SERIAL CONVERTER
RAM
117
DRIVE AMPLIFIER
116
D/A
RAM
115
114
104-3
104-2
104-1
104
51
52

FIG.19

TABLE 1: MODEL CONDITIONS

| | | |
|---|---|---|
| INK PROPERTIES | | |
| VISCOSITY | 3 | cP |
| SONIC SPEED | 1500 | m/s |
| DENSITY | 1 | g/cm$^3$ |
| GAS PROPERTIES | | |
| SONIC SPEED | 345 | m/s |
| DENSITY | 1.17 | kg/m$^3$ |
| NOZZLE DIMENSIONS | | |
| DIAMETER | 30 | μm |
| LENGTH | 30 | μm |
| CROSS-SECTIONAL AREA | 7.1E-10 | m$^2$ |
| ACTUATOR CAPACITY | | |
| VOLUME REDUCTION | 15 | pL |
| GENERATED PRESSURE | 0.65 | MPa |
| RATIO RESISTANCE/ INERTANCE OF NOZZLE AND SUPPLY SYSTEM | 1:1 | |
| DIMENSIONS OF PRESSURE CHAMBER | | |
| WIDTH | 0.8 | mm |
| LENGTH | 0.7 | mm |
| HEIGHT | 0.15 | mm |
| VOLUME | 84000 | pL |

FIG.20

TABLE 2: CAUSES OF ERROR AND EJECTION CAPACITY

| CALCULATION CONDITIONS | RESONANCE PERIOD (μs) | MAXIMUM FLOW SPEED IN NOZZLE (m/s) | RATE OF CHANGE IN RESONANCE PERIOD | RATE OF CHANGE IN FLOW SPEED IN NOZZLE |
|---|---|---|---|---|
| STANDARD CONDITIONS | 9.21 | 11.5 | 1.000 | 1.000 |
| VISCOSITY +10% | 9.22 | 11.3 | 1.001 | 0.978 |
| NOZZLE DIAMETER +5% | 8.77 | 11.3 | 0.952 | 0.978 |
| NOZZLE LENGTH +10% | 9.67 | 10.8 | 1.049 | 0.941 |
| PRESSURE CHAMBER VOLUME +10% | 9.49 | 11.1 | 1.031 | 0.963 |
| ACTUATOR CAPACITY -10% | 9.21 | 10.4 | 1.000 | 0.900 |
| ACCOUNTING ELEMENT FOR ALL VARIATIONS | 9.48 | 9.1 | 1.029 | 0.788 |
| AIR BUBBLES PRESENT (10 μm IN DIAMETER) | 9.50 | 11.1 | 1.031 | 0.964 |
| | | | SUM OF SQUARES OF FIVE VARIATION CAUSES | 0.874 |

LIQUID EJECTION APPARATUS AND LIQUID EJECTION HEAD RESTORING METHOD

BACKGROUND OF THE INVENTION

1. Field of the Invention

The present invention relates to a liquid ejection apparatus and a method for restoring a liquid ejection head, and more particularly, relates to technology for determining the ejection state of liquid from a liquid ejection head of a liquid ejection apparatus, and to a method for restoring the liquid ejection head in cases where an ejection failure is detected.

2. Description of the Related Art

As an image forming apparatus, an inkjet recording apparatus (inkjet printer) is known, which comprises an inkjet head (ink ejection head) having an arrangement of a plurality of nozzles (ink ejection ports) and which records images on a recording medium by ejecting ink (ink droplets) from the nozzles toward the recording medium while the inkjet head and the recording medium are caused to move relatively to each other.

Various methods are known as ink ejection methods for the inkjet recording apparatus of this kind. For example, one known method is a piezoelectric method, where the volume of a pressure chamber (ink pressurization chamber) is changed by causing a diaphragm forming a portion of the pressure chamber to deform due to deformation of a piezoelectric element, ink being introduced into the pressure chamber from an ink supply passage when the volume is increased, and the ink inside the pressure chamber being ejected as a droplet from the nozzle when the volume of the pressure chamber is reduced. Another known method is a thermal inkjet method where ink is heated to generate a bubble in the ink, and the ink is then ejected by means of the expansive energy created as the bubble grows.

In an image forming apparatus having an ink ejection head such as an inkjet recording apparatus, ink is supplied to the ink ejection head via an ink supply channel from an ink tank which stores ink, and this ink is ejected by one of the various ejection methods described above. However, it is necessary that ink is ejected stably in such a manner that factors, such as the ink ejection volume, the ejection velocity, the ejection direction, and the shape of the ejected ink (presence or absence of satellite droplets and volume of ink), conform to uniform values at all times.

However, during printing, the nozzles of the ink ejection head are filled with ink at all times, in order that printing can be performed as soon as a printing instruction is issued. Therefore, the ink in the nozzles is exposed to the air, and the ink in nozzles that do not perform ejection for a long period of time dries, the viscosity of the ink increases, it becomes impossible to eject ink droplets satisfactorily, and nozzle blockages may occur, leading to ejection failures. Furthermore, if the ink supply is interrupted because there is stagnation of air bubbles mixed into the ink supply channels, or the like, or if an ejection operation is continued for a long period of time, then ink refilling may be delayed, leading to ejection failures.

Due to reasons such as these, it is necessary to perform maintenance of the ejection head when an ejection failure has occurred or ink is no longer being ejected in a stable fashion as described above. Therefore, various methods have been proposed in order to determine whether ink is being ejected stably or not, and whether the ejection head has produced ejection failures or not.

For example, a method is known in which the quantity of electrical charge flowing to the electrode of a piezoelectric element which pressurizes ink in an ink pressurization chamber is measured, the ink pressure inside the ink pressurization chamber is determined on the basis of the measured quantity of electrical charge, and problems occurring in the ink flow channels, such as the presence of air bubbles in the ink flow channels, or increased fluid resistance of the ink flow channels caused by dirt, are detected on the basis of this pressure (see, for example, Japanese Patent Application Publication No.11-99646). Furthermore, in this determination process, a threshold value is established with respect to the peak value, and an abnormality is taken to have occurred if this threshold value is exceeded. For example, if the pressure value exceeds the peak value of the positive pressure during normal operation by +10%, then an abnormal increase in fluid resistance due to dirt is deduced, and if the pressure value does not reach a value of −10% of the peak value of the positive pressure during normal operation, then stagnation of air bubbles is deduced.

Furthermore, for example, a method is known in which the pressure wave created inside a pressure chamber as a result of applying a measurement voltage waveform is determined, and a drive voltage waveform suited to the characteristics of that pressure wave is calculated. Therefore, the drive waveform is controlled on the basis of the use environment, such as the temperature, and the properties of the ejection liquid, and the like, in such a manner that liquid droplets having a prescribed speed of flight and a prescribed droplet volume are ejected at all times, without any timing delay between the movement of the piezoelectric element and the pressure change, even if there is variation in the period of the pressure wave or the attenuation rate. Accordingly, variations in ejection are suppressed (see, for example, Japanese Patent Application Publication No. 7-132592).

Furthermore, for example, a method is known in which, when performing experimental ink ejection for determining the ink ejection state, the pulse width of a signal applied to a recording head is set to the minimum pulse width which allows ink to be ejected stably when the pulse signal is applied to the recording head, and hence the noise incorporated into the electrical circuitry of the determination system (electromagnetic induction noise) is reduced and stable determination can be performed (see, for example, Japanese Patent No. 3495898).

If the pulse width is set as described above, then in a recording head which ejects ink by means of thermal energy, adequate ejection conditions are not obtained in any heaters which are starting to produce deterioration in ejection, and hence an ejection failure will be detectable, thus making it possible to prevent sudden occurrence of ejection failures during image printing. Furthermore, here, the actual process of determining ejection failures is performed by means of a photosensor, such as a transmissive type photo-interrupter, or the like, which determines, outside the head, the ink droplets ejected from the nozzles by means of a direct optical method.

However, in the apparatus described in Japanese Patent Application Publication No. 11-996646, ejection failures are determined by measuring the quantity of electrical charge flowing to the drive piezoelectric element and determining the ink pressure inside the ink pressurization chamber, but there is no particular disclosure with regard to the design of the voltage waveform applied to the drive piezoelectric element when an ejection failure is determined. Moreover, Japanese Patent Application Publication No. 11-99646 indicates waveform data in the case of air bubbles that are several tens of times the size of the ejection ink droplets, or waveform data in the case of a state where the nozzles are completely blocked. However, usually, ejection failures are a problem even when there are air bubbles that are smaller than the ejection ink droplets, and various problems may arise before the nozzles become completely blocked.

Even supposing that the aforementioned data is the most extreme data, if the waveform data in the case of air bubbles which are smaller than the ejected ink droplets is estimated from the indicated data, then although there is thought to be virtually no difference during normal operation, it is difficult to determine accurately a state of ejection failure or a state preceding ejection failure in the method described in Japanese Patent Application Publication No. 11-99646. Hence, further development is required in this respect.

The method described in Japanese Patent Application Publication No. 7-132592 has the object of correcting and controlling the drive waveform with respect to causes of fluctuation, but it does not seek to measure or determine ejection failure phenomena accurately. Furthermore, in practice, in the method described in Japanese Patent Application Publication No. 7-132592, it is stated that a corrected waveform may be determined on the basis of any one or any one part of a plurality of liquid droplet ejection apparatuses, this waveform being applied to the other liquid droplet ejection apparatuses. It is also stated that, in setting the measurement voltage waveform, the voltage does not necessarily have to reach a voltage value of a level that enables ink droplets to be ejected. However, there is no specific description regarding the desirable type of waveform.

Moreover, the method according to Japanese Patent No. 3495898 describes setting the pulse width applied to the head to the minimum pulse width that allows stable ink ejection, as a beneficial head driving method when ejection failures in a head that ejects ink by means of thermal energy are determined. However, this method cannot be regarded as an optimal method for use with a piezoelectric type of head.

In this way, in the determination of ejection failures in the related liquid ejection apparatuses described above, there are still problems in respect of determination accuracy and there remains scope for further improvement. Furthermore, it is desirable that restoration (maintenance) work be carried out efficiently in cases where an ejection failure has been detected.

SUMMARY OF THE INVENTION

The present invention has been contrived in view of the foregoing circumstances, an object thereof being to provide a liquid ejection apparatus and a method for restoring a liquid ejection head, whereby the accuracy of ejection failure determination concerning a liquid ejection head is improved and restoration (maintenance) work can be carried out efficiently in cases where an ejection failure is detected.

In order to attain the aforementioned object, the present invention is directed to a liquid ejection apparatus, comprising: a liquid ejection head including an ejection port surface on which a plurality of ejection ports for ejecting a liquid toward a recording medium are arranged; a drive condition selection device which selects at least one of drive conditions for the liquid ejection head in order to eject the liquid from the ejection ports, the drive conditions including a first drive condition in which individual performance variations among the liquid droplet ejection heads in relation to ejection performance are reflected, and a second drive condition in which ambient environmental changes are reflected on the first drive condition; and an ejection failure determination device which performs determination of ejection state of the liquid, wherein, if the liquid ejection head is driven under the second drive condition during normal ejection, then the liquid ejection head is driven during the determination of the ejection state under a drive condition in which an ejection performance is equal to or less than that of the first drive condition.

According to the present invention, during normal ejection, it is possible to determine ejection failures to a high degree of accuracy, when the head is driven under a drive condition that ambient environmental changes are reflected on individual performance variations in the head.

In order to attain the aforementioned-object, the present invention is also directed to a liquid ejection apparatus, comprising: a liquid ejection head including an ejection port surface on which a plurality of ejection ports for ejecting a liquid toward a recording medium are arranged; a drive condition selection device which selects at least one of drive conditions for the liquid ejection head in order to eject the liquid from the ejection ports, the drive conditions including a first drive condition in which individual performance variations in relation to ejection performance among the liquid droplet ejection heads are reflected, a second drive condition in which ambient environmental changes are reflected on the first drive condition, and a third drive condition in which a margin is reflected on the second drive condition; and an ejection failure determination device which performs determination of ejection state of the liquid, wherein, if the liquid ejection head is driven under the third drive condition during normal ejection, then the liquid ejection head is driven during the determination of the ejection state under a drive condition in which an ejection performance is equal to or less than that of the second drive condition.

According to the present invention, during normal ejection, it is possible to determine ejection failures to a high degree of accuracy, when the head is driven under a drive condition that a margin is provided with respect to a drive condition that ambient environmental changes are reflected.

Preferably, the liquid ejection apparatus further comprises an ambient environment change measurement device which measures the ambient environmental changes. According to this, it is possible to determine ejection failures on the basis of the changes in the ambient environment.

Preferably, the liquid ejection apparatus further comprises a head restoration device which performs a restoration operation of the liquid ejection head. According to this, when an ejection failure has been detected, it is possible to implement the efficient restoration process accordingly.

Preferably, the ejection failure determination device determines pressure of the liquid in the liquid ejection head. According to this, during normal ejection (recording), it is possible to determine the ejection state without interrupting recording.

Alternatively, the ejection failure determination device determines, outside the liquid ejection head, the liquid ejected from the ejection ports. According to this, it is possible to append the determination device subsequently.

In order to attain the aforementioned object, the present invention is also directed to a method of restoring a liquid ejection head including an ejection port surface on which a plurality of ejection ports for ejecting a liquid toward a recording medium are arranged, the method comprising the steps of: selecting at least one of drive conditions for the liquid ejection head in order to eject the liquid from the ejection ports, the drive conditions including a first drive condition in which individual performance variations among the liquid droplet ejection heads in relation to ejection performance are reflected, and a second drive condition in which ambient environmental changes are reflected on the first drive condition; and performing determination of ejection state of the liquid, wherein, if the liquid ejection head is driven under the second drive condition during normal ejection, then the liquid ejection head is driven during the determination of the ejection state under a drive condition in which an ejection performance is equal to or less than that of the first drive condition.

Preferably, the method further comprises the steps of: performing purging from the ejection ports in the liquid ejection head if a result of the determination of the ejection state under the second drive condition is satisfactory and a result of the determination of the ejection state under the first drive condition is unsatisfactory; and suctioning the liquid from the ejection ports in the liquid ejection head if the result of the determination of the ejection state under the second drive condition is unsatisfactory.

In order to attain the aforementioned object, the present invention is also directed to a method of restoring a liquid ejection head including an ejection port surface on which a plurality of ejection ports for ejecting a liquid toward a recording medium are arranged, the method comprising the steps of: selecting at least one of drive conditions for the liquid ejection head in order to eject the liquid from the ejection ports, the drive conditions including a first drive condition in which individual performance variations in relation to ejection performance among the liquid droplet ejection heads are reflected, a second drive condition in which ambient environmental changes are reflected on the first drive condition, and a third drive condition in which a margin is reflected on the second drive condition; and performing determination of ejection state of the liquid, wherein, if the liquid ejection head is driven under the third drive condition during normal ejection, then the liquid ejection head is driven during the determination of the ejection state under a drive condition in which an ejection performance is equal to or less than that of the second drive condition.

Preferably, the method further comprises the steps of: performing purging from the ejection ports in the liquid ejection head if a result of the determination of the ejection state under the third drive condition is satisfactory and a result of the determination of the ejection state under the second drive condition is unsatisfactory; and suctioning the liquid from the ejection ports in the liquid ejection head if the result of the determination of the ejection state under the third drive condition is unsatisfactory.

According to these head restoration methods, it is possible to carry out restoration processing on the basis of the determined state of the ejection failure, and hence highly efficient maintenance work can be achieved.

As described above, according to the liquid ejection apparatus and the method for restoring a liquid ejection head relating to the present invention, it is possible to improve the accuracy of determining ejection failures. Furthermore, if an ejection failure is detected, a restoration process corresponding to the state of the failure can be implemented and efficient restoration work can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 15 is a block diagram showing the system composition of the section relating to the determination of ejection failures by the bar-shaped sensor;

FIG. 19 is a table showing examples of the design values of the head and the values of the ink properties;

FIG. 20 is a table showing various calculation conditions;

DETAILED DESCRIPTION OF THE PREFERRED EMBODIMENTS

Figure 1:
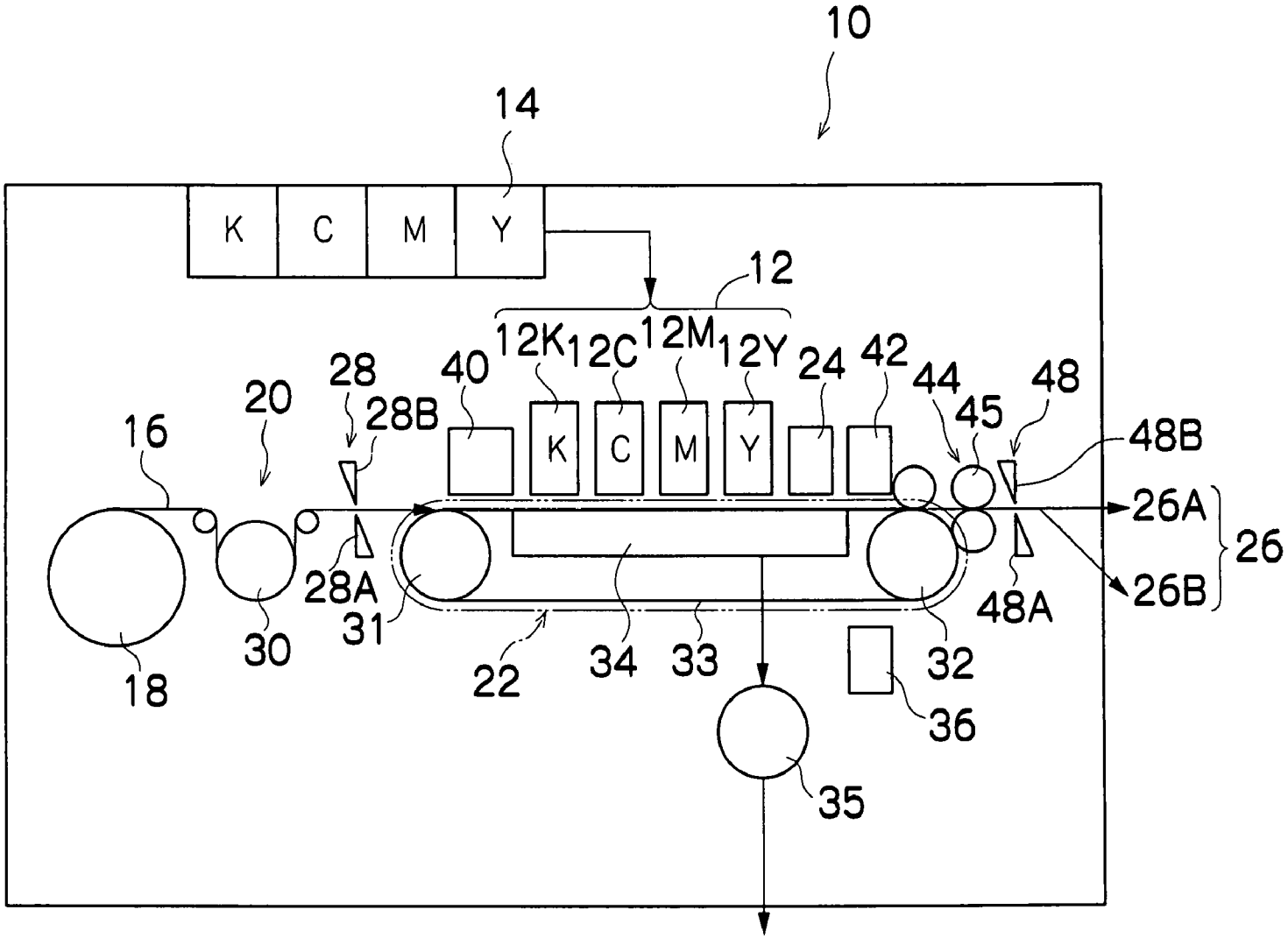
FIG. 1 is a general schematic drawing of one embodiment of an inkjet recording apparatus forming an image forming apparatus according to the present invention.

FIG. 1 is a general compositional diagram showing an approximate view of an inkjet recording apparatus forming an image forming apparatus having a liquid ejection apparatus according to a first embodiment of the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area, as shown in the present embodiment, is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
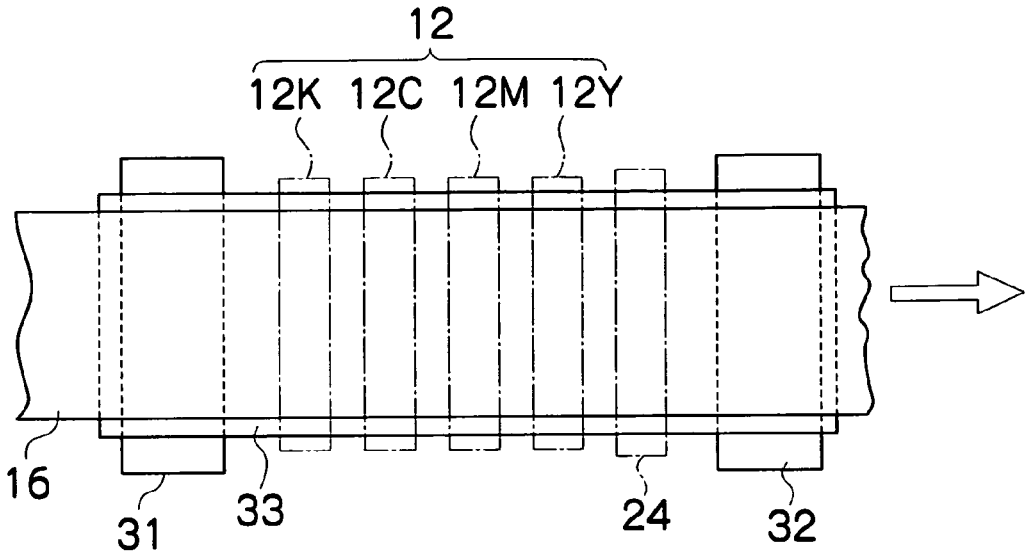
FIG. 2 is a plan view of the principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y are constituted by the line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by the main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the "sub-scanning direction". Consequently, the conveyance direction of the recording paper is the sub-scanning direction and the direction perpendicular to same is called the main scanning direction.

Although a configuration with the four standard colors, K, C, M, and Y, is described in the present embodiment, the combinations of the ink colors and the number of colors are not limited to these. Light and/or dark inks can be added the configuration as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y Each tank is connected to a respective print head 12K, 12C, 12M, 12Y, via a tube channel (not shown). Moreover, the ink storing and loading unit 14 also comprises a notifying device (display device, alarm generating device, or the like) for generating a notification if the remaining amount of ink has become low, as well as a mechanism for preventing incorrect loading of the wrong colored ink.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 according to the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of the line sensor, it is possible to use an area sensor composed of photoelectric transducing elements that are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface. The image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26 A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collecting the images according to job orders is provided in the paper output section 26A corresponding to the main images.

Figure 3:
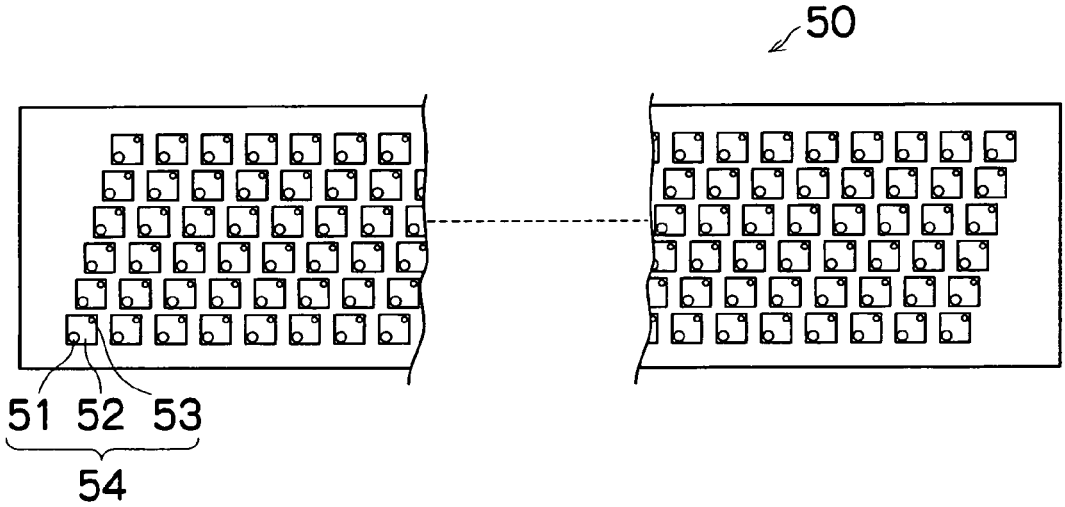
FIG. 3 is a plan perspective diagram showing an example of the structure of a print head.

Next, the arrangement of nozzles (liquid ejection ports) in the print head (liquid ejection head) will be described. The print heads 12K, 12C, 12M, and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each pressure chamber unit 54 including a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

In the example shown in FIG. 3, the pressure chambers 52 each have an approximately square planar shape when viewed from above, but the planar shape of the pressure chambers 52 is not limited to a square shape. As shown in FIG. 3, if the pressure chambers 52 have a square planar shape, then a nozzle 51 is formed at one end of the diagonal of each pressure chamber 52, and an ink supply port 53 is provided at the other end thereof.

Figure 4:
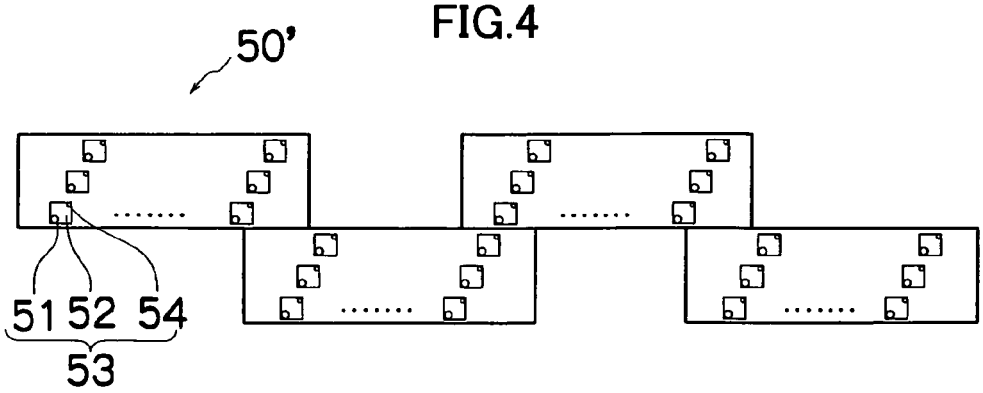
FIG. 4 is a plan view showing a further example of a print head.

Moreover, FIG. 4 is a plan view perspective diagram showing a further example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
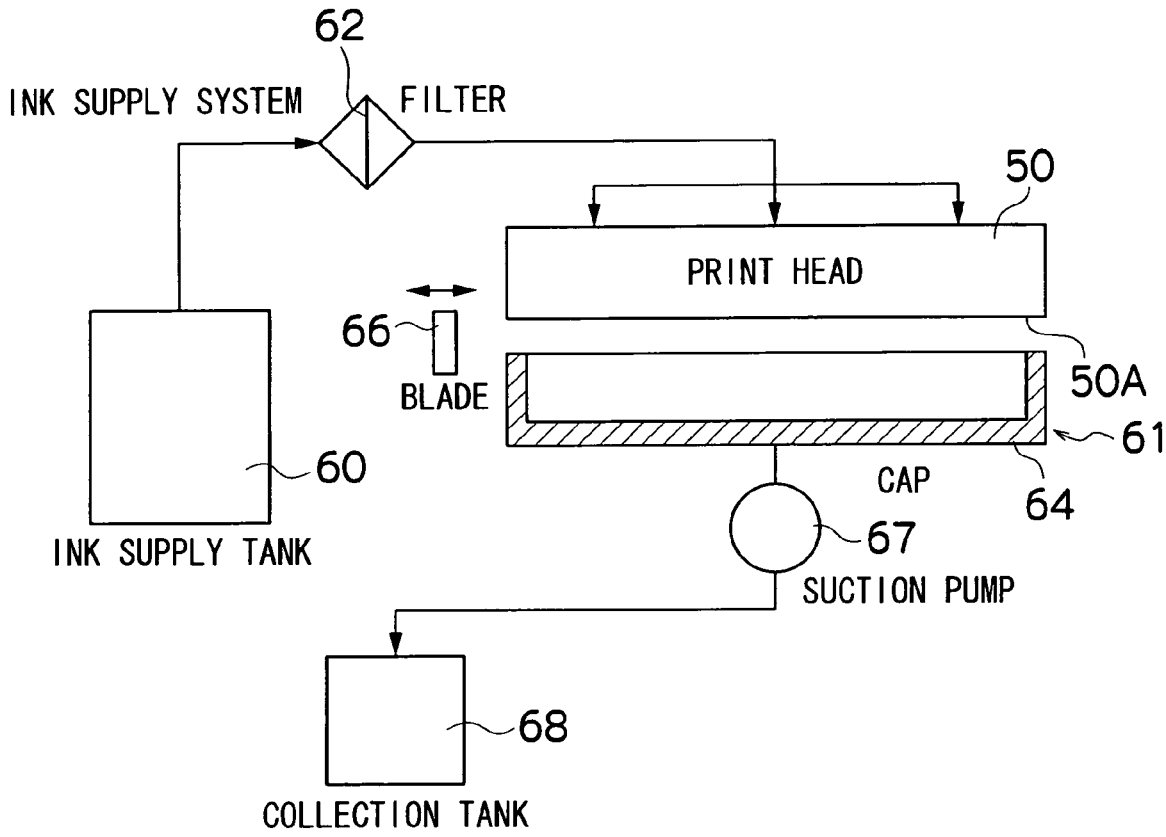
FIG. 5 is a schematic drawing showing the composition of an ink supply system in the inkjet recording apparatus according to the embodiment.

FIG. 5 is a conceptual diagram showing the composition of an ink supply system in the ink (liquid) ejection apparatus of the inkjet recording apparatus 10. The ink tank 60 is a base tank for supplying ink to the print head 50, and this ink tank 60 is disposed in the ink storing and loading unit 14 shown in FIG. 1. The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. The ink supply tank 60 in FIG. 5 is equivalent to the ink storing and loading unit 14 in FIG. 1 described above.

As shown in FIG. 5, a filter 62 for eliminating foreign material and air bubbles is provided at an intermediate position of the tubing that connects the ink tank 60 with the print head 50. Desirably, the filter mesh size is the same as the nozzle diameter in the print head 50, or smaller than the nozzle diameter (generally, about 20 μm).

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

Furthermore, the ink ejection apparatus of the inkjet recording apparatus 10 is also provided with a cap 64 forming a device to prevent the nozzles from drying out or to prevent an increase in the ink viscosity in the vicinity of the nozzles, and a cleaning blade 66 forming a device to clean the nozzle surface 50A.

A maintenance unit 61 including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by the suction is sent to a collecting tank 68. This suction operation is also carried out in order to suction and remove degraded ink which has hardened due to increasing in viscosity when ink is loaded into the print head for the first time, and when the print head starts to be used after having been out of use for a long period of time.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element (not shown, but described below) for the ejection driving is operated. Before reaching such a state (in a viscosity range that allows ejection by the operation of the piezoelectric element) the piezoelectric element is operated to perform the preliminary discharge to eject the ink of which viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, if air bubbles have become mixed into the ink in the nozzles 51 or the pressure chambers 52, or if the ink viscosity inside the nozzles 51 has risen to a certain level or above, then even if the piezoelectric elements are operated, it will be impossible to eject ink from the nozzles 51. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 shown in FIG. 5 functions as a suctioning device and it may also function as an ink receptacle for preliminary ejection.

Moreover, desirably, a composition is adopted in which the inside of the cap 64 is divided by means of partitions into a plurality of areas corresponding to the nozzle rows, thereby achieving a composition in which suction can be performed selectively in each of the demarcated areas, by means of a selector, or the like.

As described hereinafter, a restoration operation for the head (nozzles), such as purging or suctioning of this kind, is carried out as appropriate in accordance with the determination results of the ejection failure determination device.

Figure 6:
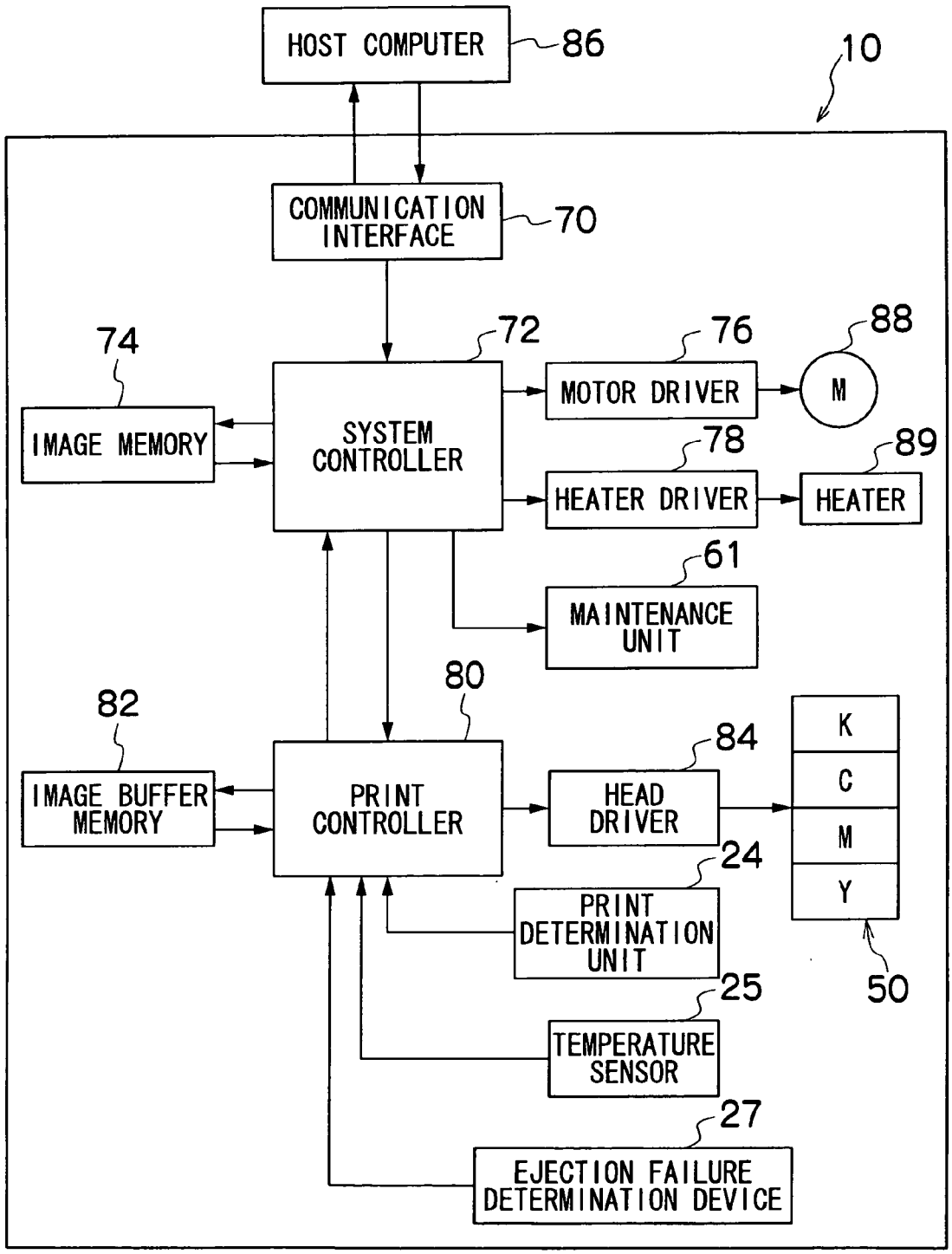
FIG. 6 is a partial block diagram showing the system composition of an inkjet recording apparatus according to the present embodiment.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 includes a central processing unit (CPU) and peripheral circuits thereof, and the like. In addition to controlling communications with the host computer 86 and controlling reading and writing from and to the image memory 74, or the like, the system controller 72 also generates a control signal for controlling the motor 88 of the conveyance system and the heater 89.

The motor driver 76 is a driver (drive circuit) which drives the motor 88 in accordance with instructions from the system controller 72. The heater driver 78 is a driver that drives the heater 89 in accordance with instructions from the system controller 72. This heater 89 includes a heater for a post drying unit 42 and a heater for heating the ink. Although described in more detail hereinafter, the heater 89 for heating ink heats the ink when there is a risk of ejection failure due to an increase in the viscosity of the ink, thereby raising the ink temperature and reducing the ink viscosity, and hence it serves to prevent ejection failures. The heater 89 for heating the ink is not limited in particular, and it may be provided in the ink tank 60 in such a manner that it raises the temperature of all of the ink, or alternatively, the heaters 89 may be provided independently for each print head 50 (for example, in the ink supply channels leading to the respective print heads 50 ) in such a manner that the ink temperature can be controlled independently in each of the print heads 50. Furthermore, it is also possible to adopt a composition that enables the ink temperature to be controlled respectively in each pressure chamber 52, or in each region comprising a plurality of pressure chambers 52.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, desired dot size and desired dot positions can be achieved.

The print controller 80 is provided with the image buffer memory 82; and image data, parameters, and other data are temporarily stored in the image buffer memory 82 when image data is processed in the print controller 80. The mode shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements of the print heads 50 of the respective colors on the basis of print data supplied by the print controller 80. The head driver 84 can be provided with a feedback control system for maintaining constant drive conditions for the print heads.

As shown in FIG. 1, the print determination unit 24 is a block including a line sensor (not shown), which reads in the image printed onto the recording paper 16, performs various signal processing operations, and the like, and determines the print situation (presence/absence of ejection, variation in droplet ejection, and the like). The print determination unit 24 supplies these detection results to the print control unit 80.

As a device (ejection failure determination device 27 ) for determining the ejection state (namely, an ejection defect, such as an ejection failure, deviation in the flight direction, or the like), besides a print determination unit 24, it is also possible to use a device which determines whether an ink droplet has actually been propelled and ejected or not, by using the light of a laser beam, or by a device which determines ejection by measuring the electrostatic capacitance of electrostatically-charged ink when the ink is propelled and ejected.

Furthermore, it is possible to use not only a device such as these devices which determines ejection failures outside the print head 50, but also a device based on an internal determination method which determines ejection failures by determining the ink pressure inside the pressure chambers 52 of the print head 50. Additionally, it is also possible to combine the external determination method with the internal determination method such as those described above.

According to requirements, the print controller 80 makes various corrections with respect to the print head 50 on the basis of information obtained from the print determination unit 24. Furthermore, as a device for measuring changes in the ambient environment which may affect the ejection state, it is also possible to provide the print head 50 with a temperature sensor 25 which measures changes in the ambient temperature, or the like. In this case, the print controller 80 uses the ink temperature determined by the temperature sensor 25, for example, to calculate the ink viscosity on the basis of a relationship between the ink temperature and the ink viscosity corresponding to previously established ink characteristics, and thus determines the ejection state. Other changes in the ambient environment that may affect the ejection state include, for example, the humidity, atmospheric pressure, or the like.

Furthermore, the print controller 80 receives a determination signal from the print determination unit 24 or an ejection failure determination device 27 located separately from the print determination unit 24, and a restoration operation (maintenance) for the print head 50 is performed by driving the maintenance unit 61 via the system controller 72, as and when necessary. The ejection failure determination and restoration operations are described in detail hereinafter.

In the present embodiment, in order to achieve high density structure in the print head, firstly, a high-density arrangement of nozzles 51 is obtained by arranging pressure chambers 52 (nozzles 51) in the form of a two-dimensional matrix (for example, 2400 npi), as shown in FIG. 3 for example. Next, the ink supply system is integrated to a high degree by disposing a common liquid chamber for supplying ink to the pressure chambers 52 above the diaphragm, and ink refilling characteristics are prioritized by eliminating lines which cause flow resistance, in such a manner that the ink is supplied directly from this common liquid chamber to the pressure chambers 52. Furthermore, in the present embodiment, the piezoelectric element wiring which supplies drive signals to the electrodes (individual electrodes) of the piezoelectric elements that deform the pressure chambers 52 rises upward vertically from each individual electrode and is connected to upper wiring, such as a flexible cable, in such a manner that it passes through the common liquid chamber.

Figure 7:
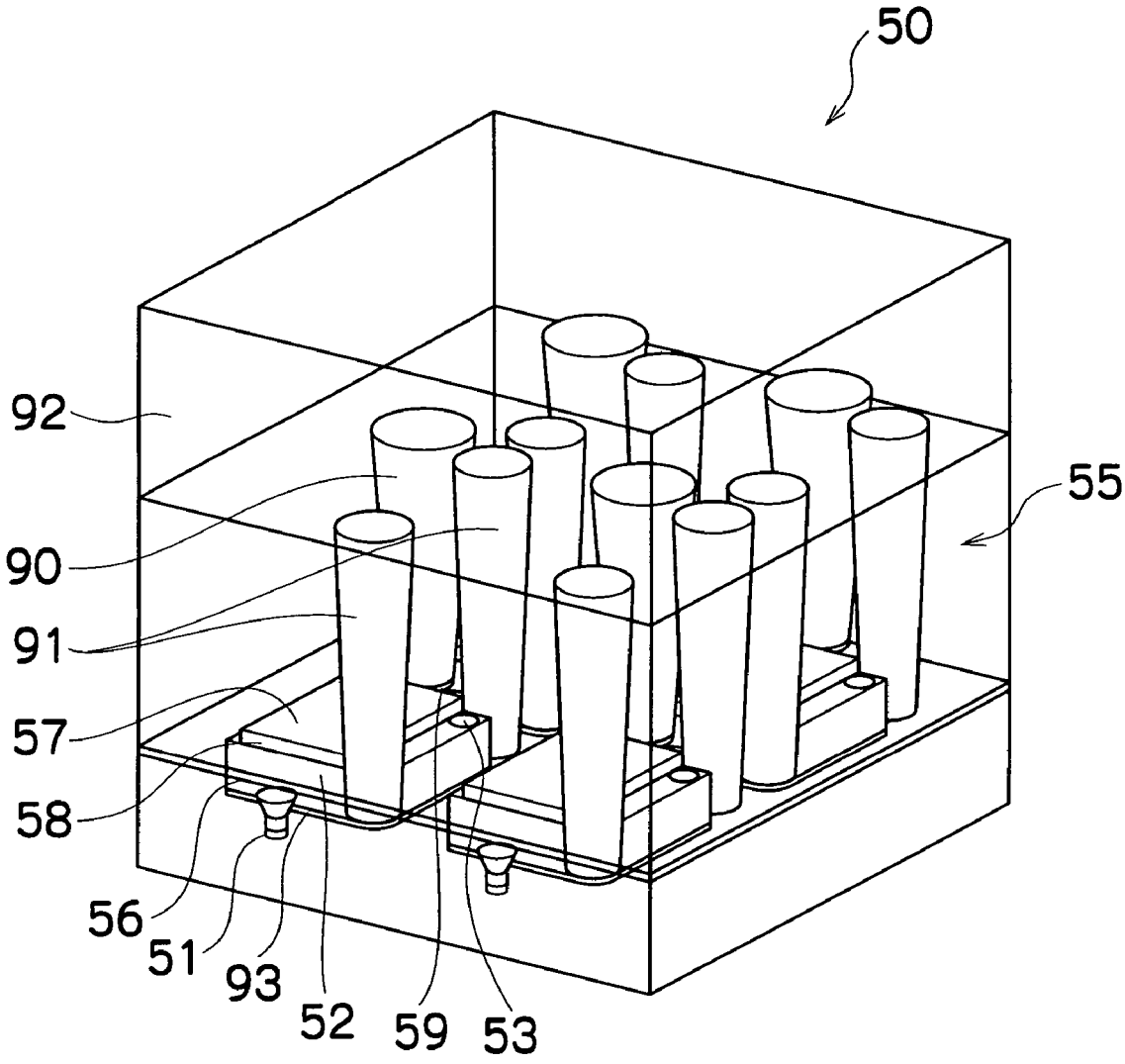
FIG. 7 is an oblique perspective diagram showing a partial enlarged view of the print head according to the embodiment.

FIG. 7 shows a simplified oblique perspective view of one portion of the print head 50 with a high density structure in this way.

As shown in FIG. 7, in the print head 50 according to the present embodiment, a diaphragm 56 forming a ceiling of the pressure chambers 52 is disposed, as a single common plate for the plurality of pressure chambers 52, on the upper side of the pressure chambers 52 each having the nozzle 51 and the ink supply port 53. Furthermore, piezoelectric elements 58 (piezoelectric actuators) each constituted by a piezoelectric body sandwiched between upper and lower electrodes, are disposed on the diaphragm 56 in regions corresponding to the pressure chambers 52, and an individual electrode 57 is provided on the upper surface of each piezoelectric element 58.

An electrode pad 59 forming an electrode connecting section is extracted to the outer side from the end face of each individual electrode 57, and a column-shaped electrical wire 90 is formed on this electrode pad 59 so as to rise up in a perpendicular direction. A multi-layer flexible cable 92 is provided above the piezoelectric element wires 90 which rise up in a perpendicular direction, and drive signals are supplied from the head driver 84 to the individual electrodes 57 of the piezoelectric elements 58 via these wires.

Furthermore, pressure sensors 93 forming ejection failure determination devices 27 based on an internal pressure determination system, are provided on the under surface of the pressure chambers 52. There are no particular limitations on the pressure sensors 93, and one of the suitable examples of the pressure sensor is a piezoelectric element layer made of polyvinylidene fluoride (PVDF), or the like.

Furthermore, the wires (sensor wires) 91 for extracting determination signals from the pressure sensors 93 are formed respectively in pairs for each pressure sensor 93, in such a manner that they rise up perpendicularly from the two electrodes which are placed on either side of the pressure sensors 93.

Moreover, the space in which the column-shaped piezoelectric element wires 90 and the sensor wires 91 are erected between the diaphragms 56 and the flexible cable 92 is formed as a common liquid chamber 55 for supplying ink to the respective pressure chambers 52 via the respective ink supply ports 53.

The common liquid chamber 55 shown here is one large space formed throughout the whole region where the pressure chambers 52 are formed, in such a manner that it supplies ink to all of the pressure chambers 52 shown in FIG. 3. However, the common liquid chamber 55 is not limited to being formed into one space, and a plurality of chambers may be formed by dividing up the space into several regions.

The piezoelectric element wires 90 which rise up perpendicularly like columns from the electrode pads 59 extracted from the individual electrodes 57 at each pressure chamber 52, and the sensor wires 91 which rise up perpendicularly like columns from the electrodes of the pressure sensors 93 support the flexible cable 92 from below and thus create a space which forms the common liquid chamber 55.

The piezoelectric element wires 90 and the sensor wires 91 that rise up like columns in this manner are also called "electrical columns" and "sensor columns", due to their shape. The piezoelectric element wires (electrical columns) 90 and the sensor wires (sensor columns) 91 are formed so as to pass respectively through the common liquid chamber 55.

Concerning the piezoelectric element wires 90 shown here, the single piezoelectric element wire 90 is formed independently with respect to each of the piezoelectric elements 58 (or the individual electrodes 57 thereof), in a one-to-one correspondence. In order to reduce the number of the wires (the number of the electrical columns), it is also possible to make one piezoelectric element wire 90 correspond to a plurality of piezoelectric elements 58, in such a manner that the wires corresponding to some piezoelectric elements 58 are gathered together and formed into one piezoelectric element wire 90. In this case, the plurality of wires connected to the individual electrodes of the plurality of piezoelectric elements 58 are gathered together in a respectively independent (electrically-isolated) state, when they are formed into one piezoelectric element wire 90. Moreover, the sensor wires 91 and the wires to the common electrodes (the diaphragms 56 ) may also be gathered together with the piezoelectric element wires 90, in such a manner that they form one column.

Nozzles 51 are formed in the bottom surface as shown in FIG. 7, and ink supply ports 53 are provided on the upper surface in a corner section that is symmetrical with respect to the nozzle 51. The ink supply ports 53 are pierced through the diaphragm 56, and the upper-positioned common liquid chamber 55 and the pressure chambers 52 are connected directly by means of the ink supply ports 53. Consequently, it is possible to form a direct fluid connection between the common liquid chamber 55 and each of the pressure chambers 52.

As described above, the diaphragm 56 is formed as a single plate that is common to all of the pressure chambers 52. Piezoelectric elements 58 for deforming the pressure chambers 52 are disposed on the diaphragm 56 in positions corresponding to the respective pressure chambers 52. Electrodes (a common electrode and an individual electrode) for driving the piezoelectric elements 58 by applying a voltage to same are formed on the upper and lower surfaces of each piezoelectric element 58, thereby sandwiching the piezoelectric element 58.

The diaphragm 56 may be formed as a thin conductive film made of stainless steel, or the like, in such a manner that the diaphragm 56 may also serve as a common electrode. In this case, an individual electrode 57 for driving the piezoelectric element 58 independently is provided on the upper surface of each of the piezoelectric elements 58.

As described above, an electrode pad 59 is formed leading from each individual electrode 57, and a piezoelectric element wire 90 (electrical column) which passes through the common liquid chamber 55 is formed rising up perpendicularly on the electrode pad 59. The multi-layer flexible cable 92 is formed on top of the column-shaped piezoelectric element wires 90, in such a manner that the multi-layer flexible cable 92 is supported by the pillars formed by the electrical wires 90 and sensor wires 91, and the space forming the common liquid chamber 55 is created by taking the diaphragm 56 as the base, and the multi-layer flexible cable 92 as the ceiling. Although not shown in the drawings, the respective individual electrodes 57 are each connected independently to the respective piezoelectric element wires 90, in such a manner that drive signals are supplied respectively to the individual electrodes 57, thereby driving the piezoelectric elements 58.

Furthermore, although not shown in FIG. 7, since the common liquid chamber 55 is filled with ink, the surfaces of the diaphragm forming the common electrode 56, the individual electrodes 57, the piezoelectric element wires 90, the sensor wires 91, and the multi-layer flexible cable 92 which make contact with the ink are covered respectively with an insulating protective film.

Figure 8:
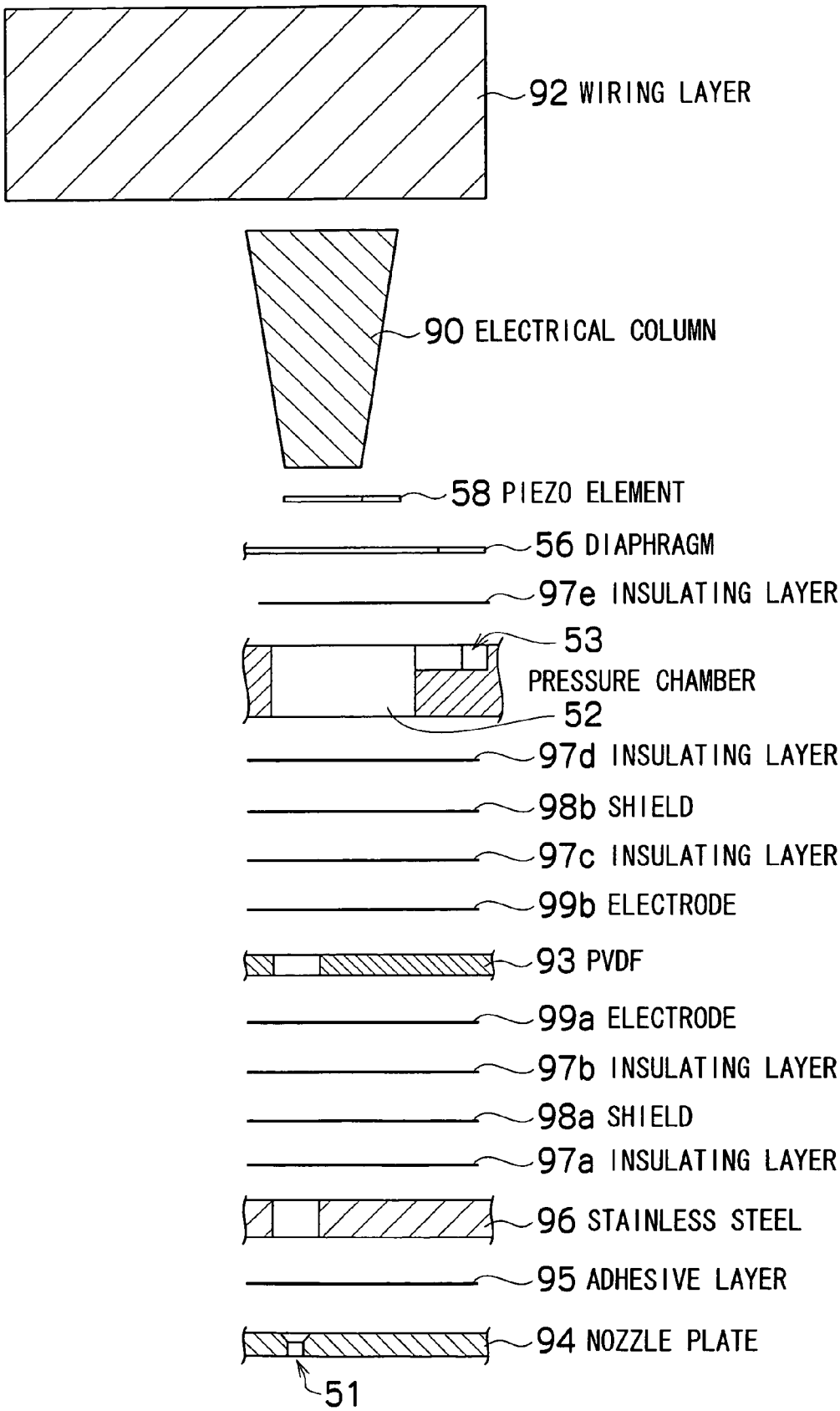
FIG. 8 is a side view showing an exploded view of the respective elements that constitute a print head.

FIG. 8 shows an exploded side view of the respective elements which form the print head 50 of this kind, and FIGS. 9A to 9D are plan views of a portion of these elements. In FIG. 8, the sensor columns (sensor wires) 91 are omitted.

Figure 9A:
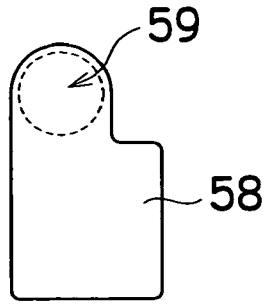
FIGS. 9A to 9D are cross-sectional diagrams showing one portion of the elements shown in FIG. 8.
Figure 9B:
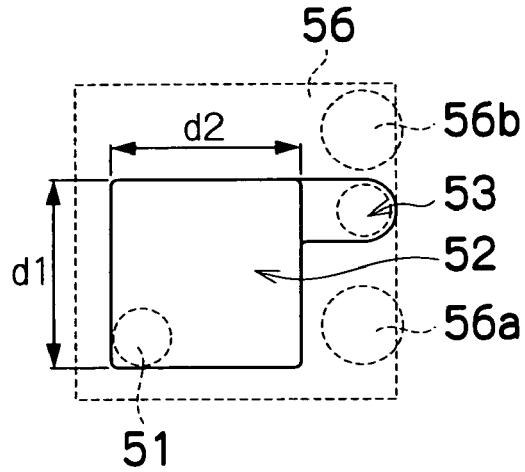

As shown in FIG. 8, the print head 50 according to the present embodiment is formed by laminating together various thin film layers. Starting the description from the lower end of these layers, firstly, a nozzle plate 94 formed with nozzles 51 in prescribed positions as shown in FIG. 9D is bonded to a base plate 96 made of stainless steel, or the like, by means of an adhesive layer 95. An insulating layer 97*a* which also serves as a bonding layer, a shield 98*a*, and an insulating layer 97*b* are then laminated onto the base plate 96. The pressure sensor 93 constituted by a PVDF layer sandwiched between two electrodes 99*a* and 99*b* is then laminated thereon.

Figure 9C:
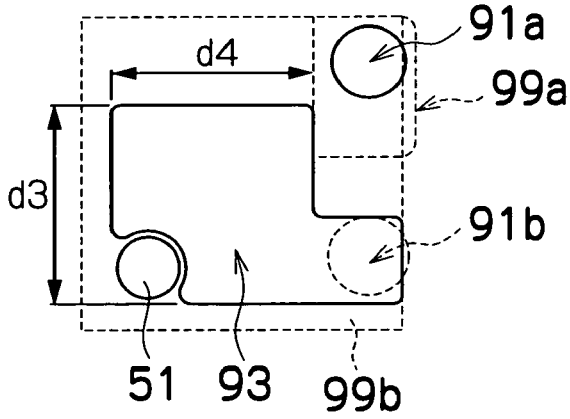
Figure 9D:
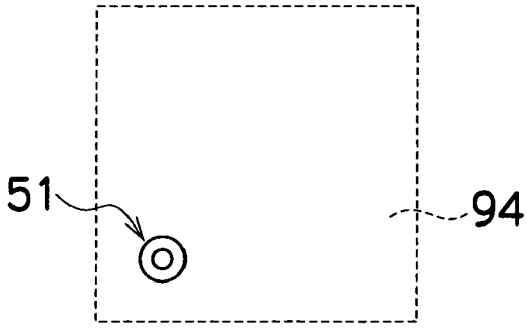

As shown in FIG. 9C, the pressure sensor 93 is formed on the lower surface of the pressure chamber 52, at a position that avoids the region of the nozzle 51. Furthermore, electrode pads 91*a* and 91*b* connected respectively to sensor wires 91, 91 are provided at the ends of the two electrodes 99*a* and 99*b* that form the pressure sensor 93.

Furthermore, an insulating layer 97*c*, a shield 98*b*, and an insulating layer 97*d* that also serves as a bonding layer, are laminated thereon, and thus form an approximately square-shaped pressure chamber 52 as shown in FIG. 9B. A diaphragm 56 bonded to an insulating layer 97*e* is formed on top of the pressure chamber 52. As shown in FIG. 9B, an ink supply port 53 is formed by laterally extending the side of the pressure chamber 52 symmetrically opposed to the region where the nozzle 51 is formed. Furthermore, through holes 56*a* and 56*b* are formed in the diaphragm 56 in order that the sensor wires 91 and 91 pass through the holes.

Moreover, a piezoelectric element 58 such as that shown in FIG. 9A is formed on the diaphragm 56. Although omitted from FIG. 8, an individual electrode 57 and an electrode pad 59 extracted from this electrode are formed on the piezoelectric element 58, an electrical column (electrical wire) 90 is formed thereon, and the flexible cable 92 constituting a wiring layer is formed on the electrical column 90.

To give an example of the dimensions of the respective elements, the layers have the following thicknesses. For example, the nozzle plate 94 is 50 μm thick, and the bonding layer 95 is 2 μm thick. Furthermore, the PVDF pressure sensor 93 is 40 μm thick, but in terms of the output voltage, it can be formed to a thickness of approximately 10 μm. The output at the thickness of 40 μm is approximately several Volts. This layer has less effect on the ejection specifications, the smaller its thickness. By reducing the height of the pressure chamber 52 in accordance with the thickness of the PVDF layer, it is possible to keep the ink compliance virtually uniform. Furthermore, the internal diameter of the hole in the nozzle section 51 is 100 μm, and the hole is offset in such a manner that the electrodes are not exposed to the liquid flow channel.

Furthermore, the electrodes 99*a* and 99*b* are 1 μm thick. The thickness of each of the insulating layers 90*a*-90*e*, which also serve as the bonding layers, is 5 μm when they are made from polyimide, for example. Furthermore, the noise shields (shield layers 98*a* and 98*b*) must have sufficient thickness to meet the determination sensitivity on the ink side, and hence the thinner the shields, the better. Therefore, the shields are formed to a thickness of approximately 1 μm by sputtering, application (and patterning), or the like. The length of the sensor wire (sensor column) 91 is approximately 200 μm greater than that of the electrical wire (electrical column) 90, due to the height of the pressure chamber 52 and the thickness of the PVDF layer. A hole is opened in the actual PVDF layer in such a manner that one of the sensor wires 91 is connected to the electrode 99*a* on the lower side of the pressure sensor 93.

If the PVDF layer 93 used for pressure determination is a g33 mode (compressive type) element, then the stainless steel base plate 96 is formed to a thickness of 80 μm, since the smaller the deformation of the base plate 96, the lower the loss in the volume reduction of the ink from the pressure chamber 52. If this layer is 80 μm thick, then the increase in twisting due to internal pressure is not more than 1% of the volume reduction, and that is no problem.

Furthermore, if a g31 mode (torsion type) element is used in the PVDF 93 layer for pressure determination, then supposing that approximately 10% of the volume reduction caused by the drive piezoelectric element 58 is used in order to bend the pressure chamber 93, the base plate 96 will have a thickness of approximately 35 μm to 40 μm. In this case, a signal based on the g33 mode effect is also created by the internal pressure, so although the signal generation efficiency is not necessarily poor, if the base plate 96 is bent, the nozzle will also be displaced, and the accuracy of the flight direction of the ink will not be particularly desirable.

In the actual manufacturing process, an integrated sheet formed by applying the electrodes 99*a* and 99*b*, the insulating layers 97*a*, 97*b*, 97*c* and 97*d*, and the shield layers 98*a* and 98*b* to the PVDF layer is laminated with a stainless steel plate. Alternatively, respective layers may be formed successively on the stainless steel base plate 96, whereupon this plate is laminated with another stainless steel base plate. Subsequently, electrical wires 90 and the like are installed.

Furthermore, in FIG. 9B, the dimensions of the pressure chamber 52 are such that the vertical and lateral widths are respectively d1=d2=300 μm, and the height is 150 μm. In FIG. 9C, the vertical and lateral widths of the pressure sensor 93 are respectively d3=d4=320 μm.

Figure 10:
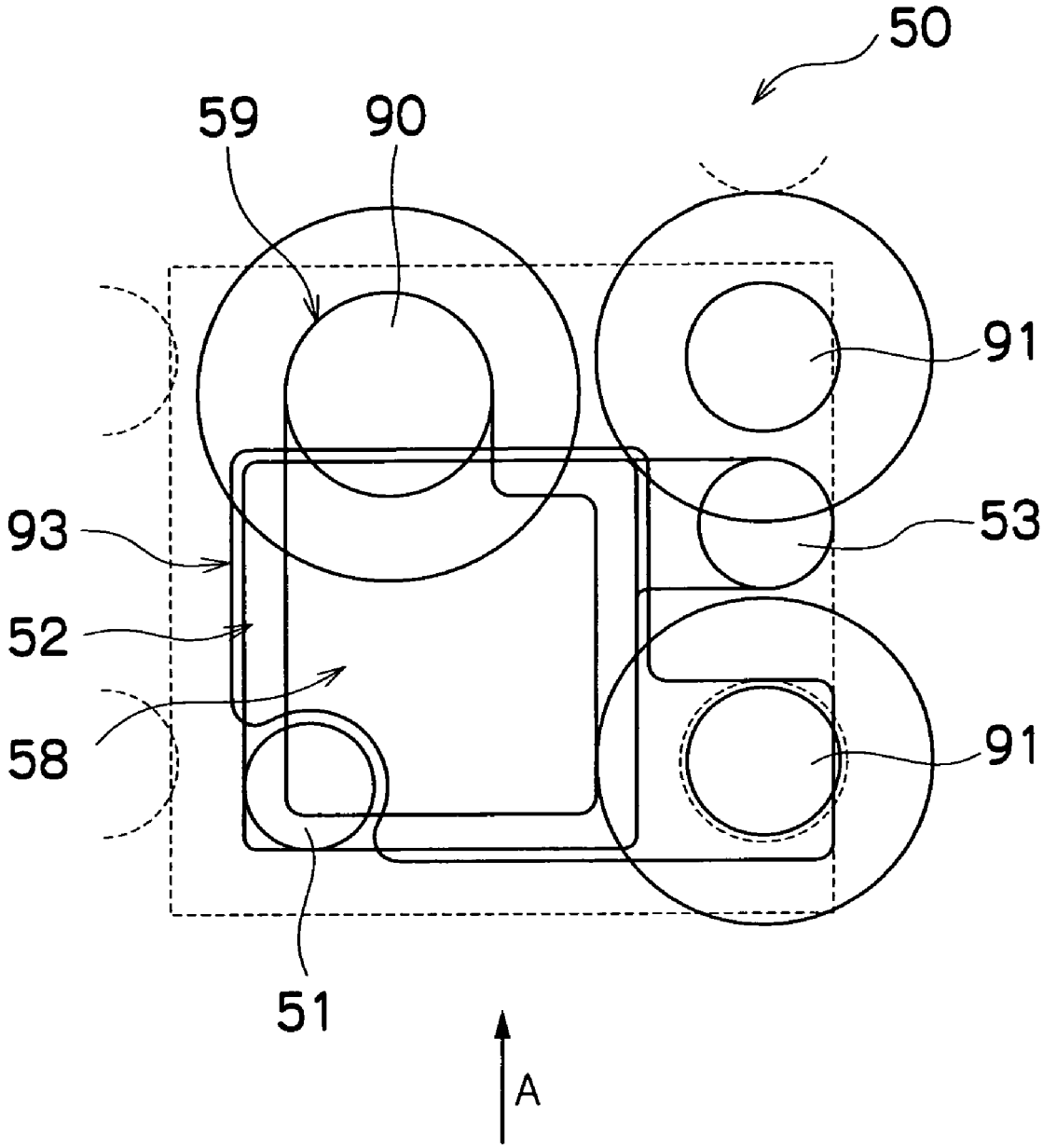
FIG. 10 is a plan diagram showing a state where the constituent elements in FIG. 8 are laminated together.

FIG. 10 shows a plan view perspective diagram in which all of these layers have been laminated together. As shown in FIG. 10, a nozzle 51 is formed in a corner on one diagonal of the pressure chamber 52, and an ink supply port 53 is formed in a portion extending laterally from the other end of the same diagonal. Furthermore, the piezoelectric element 58 is formed on the pressure chamber 52 to a slightly smaller size than the pressure chamber 52, and a portion thereof is extracted toward the upper side in the diagram and formed into the electrode pad 59, from which an electrical column (electrical wire) 90 is erected.

Figure 11:
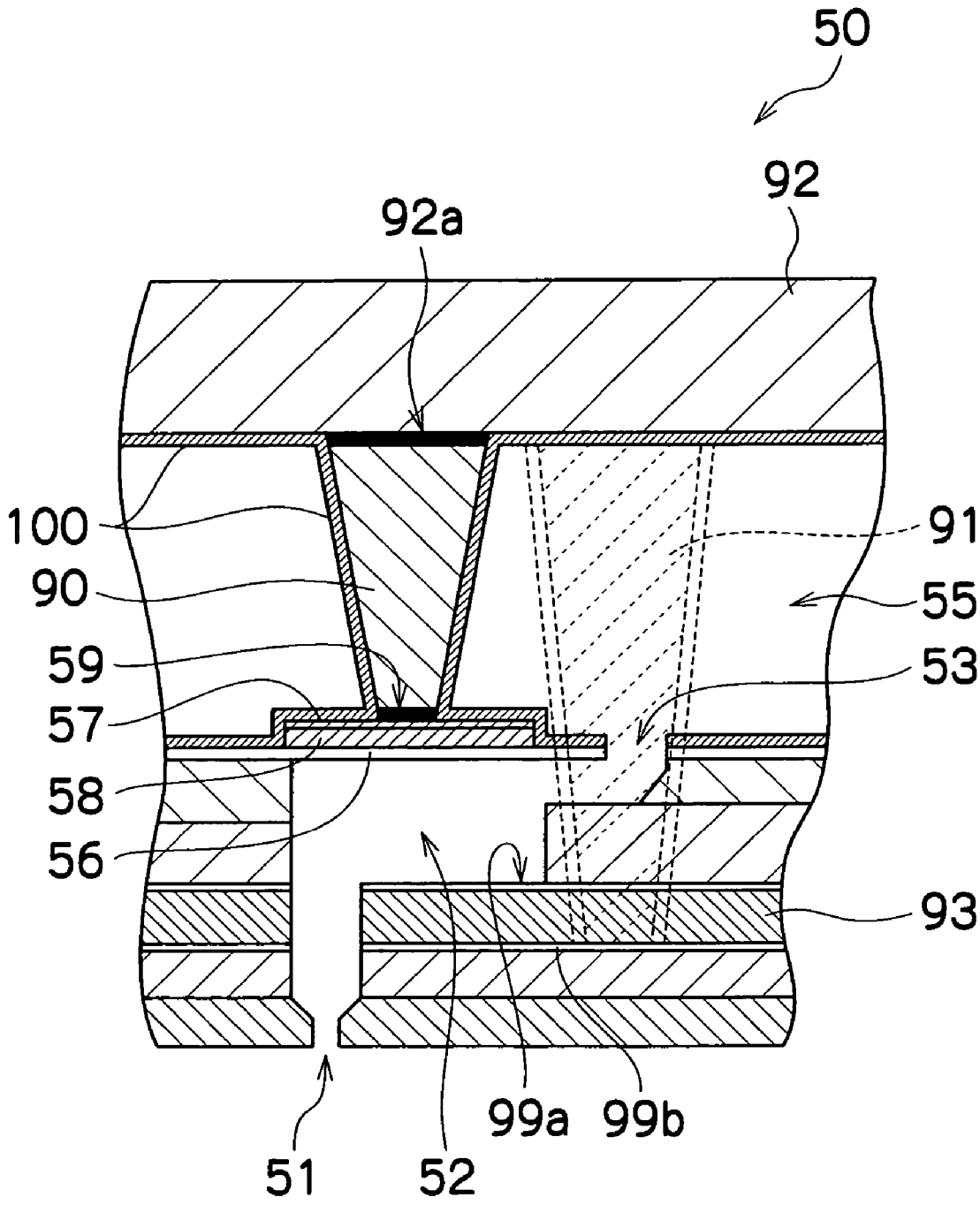
FIG. 11 is a cross-sectional perspective diagram of FIG. 10 viewed in the direction of arrow A.

Furthermore, the pressure sensor 93 is formed so as to create the lower face of the pressure chamber 52, to a slightly larger size than the pressure chamber 52 and in such a manner that it avoids the region of the nozzle 51. Sensor columns (sensor wires) 91 and 91 are erected perpendicularly from these electrodes of the pressure sensor 93. Moreover, FIG. 11 shows a side view cross-sectional diagram of the print head 50 in FIG. 10 as observed in the direction of arrow A in the diagram. In FIG. 11, the sensor column 91 overlaps with the ink supply port 53, and therefore it is depicted by broken lines.

As shown in FIG. 11, the print head 50 has column-shaped electrical wires (electrical columns) 90 erected perpendicularly on electrode pads 59 extracted from the individual electrodes 57 of the piezoelectric elements 58 formed on the diaphragm 56 which constitutes the ceiling of the pressure chambers 52. Accordingly, the common liquid chamber 55 is formed on the upper side of the pressure chambers 52, in such a manner that ink is supplied directly to the pressure chambers 52 from the common liquid chamber 55 via the ink supply ports 53 provided in the diaphragm 56.

Furthermore, the electrical wires 90 are connected to the multi-layer flexible cable 92 and electrode pads 92 a formed above them. In addition, an insulating and protective layer 100 is formed on the surfaces of the individual electrodes 57 of the piezoelectric elements 58, and the electrical wires 90 and the multi-layer flexible cable 92, which constitute the common liquid chamber 55.

Furthermore, the pressure sensor 93 for determining the pressure of the ink inside the pressure chamber 52 is formed on the base surface of each pressure chamber 52. The pressure sensor 93 is constituted by a piezoelectric element made of PVDF, or the like, and it determines the pressure by converting the deformation of the sensor caused by pressure, into a voltage change. Similarly to the electrical wires (electrical columns) 90, the sensor wires (sensor columns) 91, 91 for extracting determination signals from the electrodes 99*a* and 99*b* formed on either surface of the pressure sensor 93 are erected perpendicularly from the respective electrodes 99*a* and 99*b*.

In the example shown in FIG. 11, a determination signal from the pressure sensor 93 is extracted from the electrodes 99*a* and 99*b*, by means of the sensor columns 91 and 91, independently for each pressure chamber 52. Thereby, a merit is obtained in that the pressure sensors 93 have high anti-noise performance.

Figure 12:
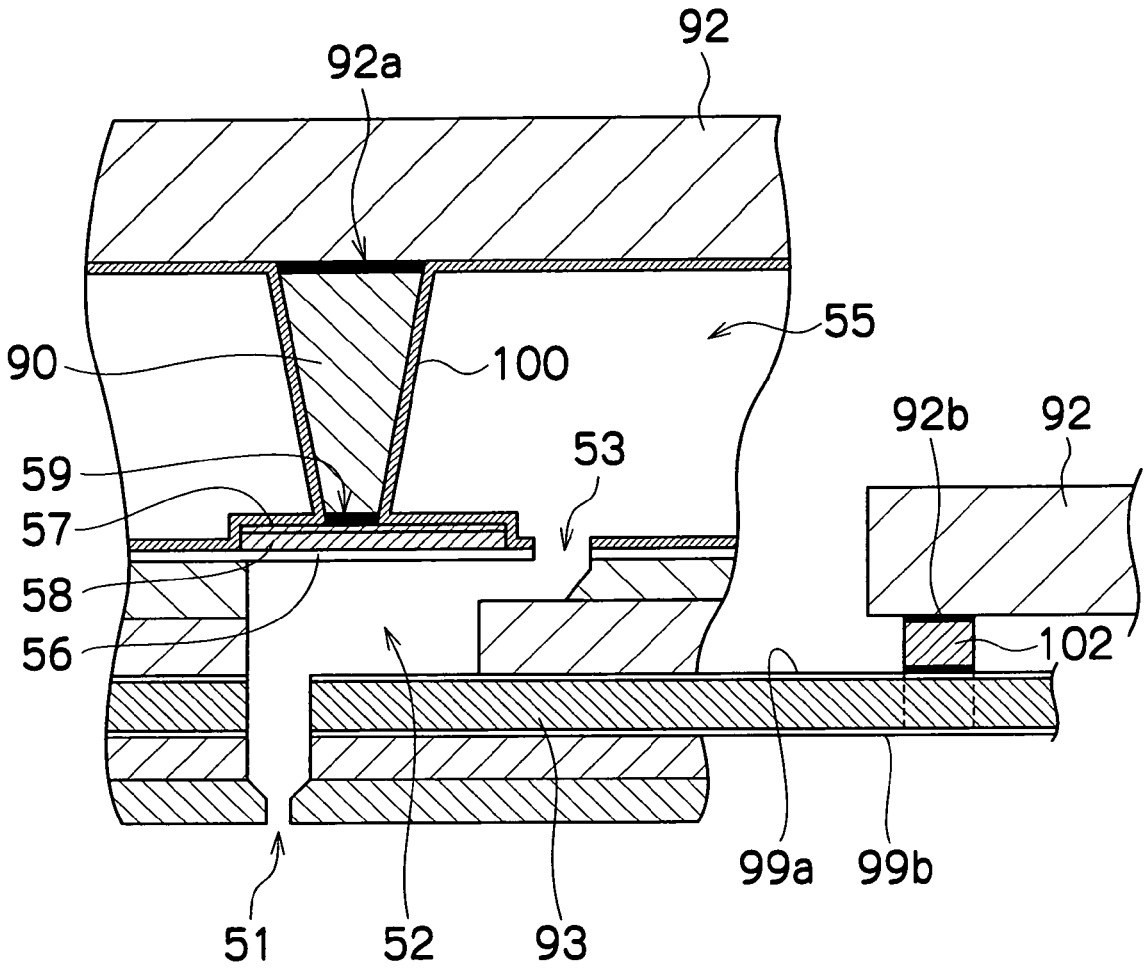
FIG. 12 is a cross-sectional diagram similar to FIG. 11, showing a further wiring method.

On the other hand, FIG. 12 shows a further method of extracting a pressure determination signal. In the device shown in FIG. 12, the determination signal is extracted from the end surface of a laminated print head 50.

As shown in FIG. 12, in this example, the pressure sensor 93 formed with the electrodes 99*a* and 99*b* respectively on the front and rear surfaces thereof is elongated directly in a lateral direction, and at the end surfaces thereof, connection terminals 102 connected respectively to the electrodes 99*a* and 99*b* are connected to electrode pads 92*b* of the flexible cable 92, in such a manner that the pressure determination signal can be extracted.

As in the case of the above-described example shown in FIG. 11, in this case, it is possible to extract signals independently for each pressure chamber 52, and the wires can be extracted in a matrix fashion or alternatively, common wires can be extracted from a plurality of nozzles.

Apart from the composition relating to the extraction of the pressure determination signals, the composition in FIG. 12 is similar to that in FIG. 11 described above, and hence similar parts are labeled with the same reference numerals and detailed description thereof is omitted.

The pressure sensor 93 described above is a flat plate-shaped sensor, but next, a long and thin bar-shaped sensor will be described, as an example of a sensor which determines the internal pressure of the pressure chamber 52 by being embedded inside the pressure chamber 52.

Figure 13:
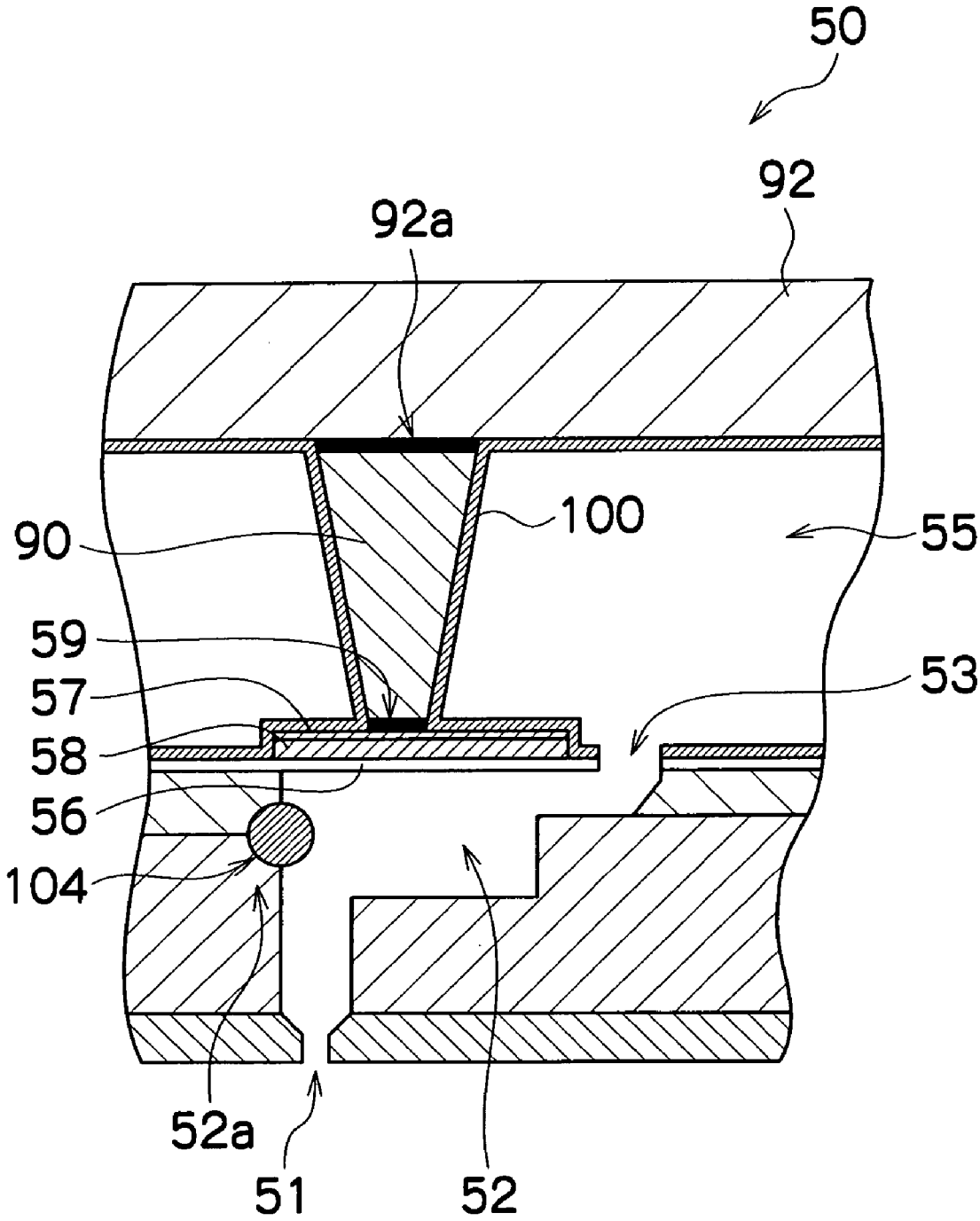
FIG. 13 is a cross-sectional diagram similar to FIG. 11, showing a further pressure determination device.

FIG. 13 is a cross-sectional diagram of the print head showing a state where a bar-shaped sensor is embedded into the inner wall of the pressure chamber in the vicinity of the nozzle, so as to pass through the pressure chamber in the manner of a skewer.

As shown in FIG. 13, in this embodiment, instead of the flat plate-shaped pressure sensor 93, a bar-shaped sensor 104 is embedded in the inner wall 52*a* of the pressure chamber 52 in the vicinity of the nozzle 51. In FIG. 13, the compositional elements apart the pressure sensor are similar to those shown in FIG. 11 or FIG. 12 above, and hence, the same reference numerals are applied to the same constituent elements and detailed description thereof is omitted here.

Figure 14A:
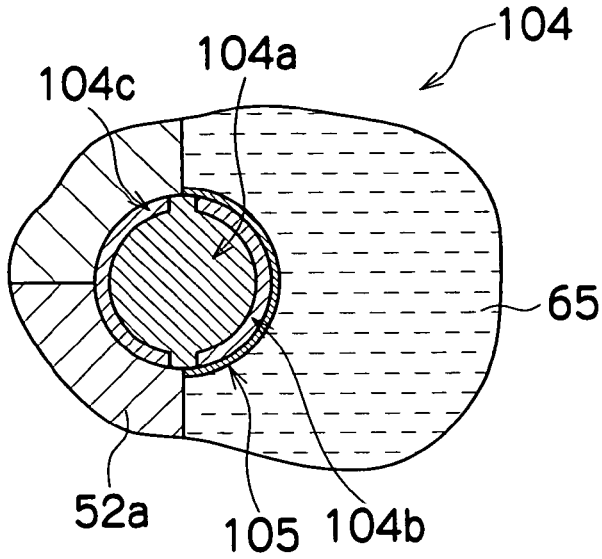
FIG. 14A is a cross-sectional diagram showing an enlarged view of the bar-shaped sensor in FIG. 13.

FIG. 14A is a cross-sectional diagram showing an enlarged view of the bar-shaped sensor 104 in a direction perpendicular to the lengthwise direction of the sensor. The bar-shaped sensor 104 comprises a circular bar-shaped determination piezoelectric element 104*a* of which lengthwise direction runs parallel with the inner wall 52*a* of the pressure chamber 52, which is disposed having approximately one half of the side face thereof embedded in the inner wall 52*a* in such a manner that it receives pressure from the ink 65. One suitable example of the bar-shaped sensor 104*a* is, for instance, a composite piezoelectric element in which piezo elements are fixed by resin in the form of fibers.

Electrodes 104*b* and 104*c* are formed respectively in the side face of the bar-shaped sensor 104*a* which faces toward the ink 65, and in the side face opposite this, which is embedded in the inner wall 52*a*, a uniform interval being allowed between the electrodes. Furthermore, a protective layer 105 is provided on the surface of the electrode 104*b* which makes contact with the ink 65.

As in the case of the flat plate-shaped pressure sensor 93 described above, these two electrodes 104*b* and 104*c* are able to determine the pressure in each pressure chamber 52 independently, by taking one electrode as the common electrode and taking the other electrode as the individual electrode. For example, the electrode 104*b* on the side facing the ink 65 may be taken as the common electrode and the electrode 104*c* on the opposite side, which is embedded in the inner wall 52*a*, may be taken as the individual electrode.

Here, the piezoelectric element is used in order to determine the pressure, but the present embodiment is not necessarily limited to being a piezoelectric element, and it is possible to use any type of pressure determination sensor. Furthermore, the shape of the sensor (pressure determination device) may be modified partially from a flat plate shape or bar shape into another suitable shape, provided that this still allows easy handling and does not impair assembly characteristics.

Figure 14B:
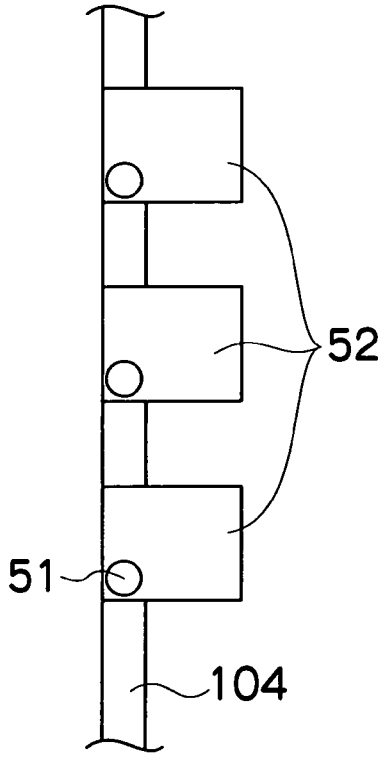
FIG. 14B is a plan diagram showing a state where a bar-shaped sensor is disposed in a plurality of pressure chambers.

Moreover, FIG. 14B shows a state where the bar-shaped sensor 104 is passed through the plurality of pressure chambers 52. In this way, the bar-shaped sensor 104 is disposed in parallel with the inner walls of the plurality of pressure chambers 52 in the vicinity of the nozzles 51 (see FIG. 13), with approximately one half of the sensor being embedded in the inner walls. Thereby, it is possible to determine the ink pressure in the plurality of pressure chambers 52 by means of the single bar-shaped sensor 104.

FIG. 15 is a block diagram principally showing the system composition of the section relating to the determination of ejection failures by the bar-shaped sensor 104.

As shown in FIG. 15, the composition for determining ejection failures and preventing ejection failures in the inkjet recording apparatus 10 principally comprises the system controller 72, a head controller 106, a drive waveform data generation processor 107, a dot data generation processor 108, an ejection failure determination controller 109, an ejection failure data processor 110, and the like.

Furthermore, this embodiment shows a composition where, in the print head 50 in which the pressure chambers 52 are arranged in the form of the two-dimensional matrix as shown in FIG. 3, the thin bar-shaped sensors 104 such as that shown in FIG. 14B are disposed passing through the pressure chambers 52 aligned in the respective rows (in the lengthwise direction of the print head 50 ), in such a manner that the plurality of pressure chambers 52 aligned in one row are determined by means of the single bar-shaped sensor 104.

In FIG. 15, in order to simplify the illustration, the pressure chambers 52 having the nozzles 51 arranged in three rows of five chambers each are depicted, and the bar-shaped sensors 104 (104-1, 104-2, 104-3) are disposed respectively passing through the five pressure chambers 52 in each row. However, in practice, a larger number of the pressure chambers 52 and the bar-shaped sensors 104 are arranged in the head.

In determining ejection failures, the piezoelectric elements 58 which cause ejection in the respective pressure chambers 52 are driven for pressure determination at or below the drive condition for normal ejection, and the ink pressure generated in the ink inside the pressure chambers 52 at that time is determined by means of the bar-shaped sensors 104 embedded inside the pressure chambers 52. In this way, ejection failures are determined. The electric pressure signals determined by the electrodes of the bar-shaped sensors 104-1, 104-2 and 104-3 in this case are extracted, separately for each row, by switching of a switch circuit 112 that is controlled by a determination multiplexer logic unit 111.

Furthermore, signal wires for supplying drive waveforms to the ejection piezoelectric elements 58 which drive the respective pressure chambers 52 in order to eject ink are connected to the pressure chambers 52 in each row, and these signal wires can be switched by means of a switching circuit 114 which is controlled by a drive multiplexer logic unit 113.

The system controller 72 receives print data for text, images, or the like, from an external source, and controls the printing process, by respectively controlling the head controller 106, the ejection failure determination controller 109, and other controllers not shown in the drawings, such as a conveyance controller which controls the conveyance of the recording paper 16, or a head maintenance controller which controls restoration processing in the event that an ejection abnormality has occurred in the head.

The head controller 106 instructs the dot data generation processor 108 to generate print dots on the basis of the commands and data supplied by the system controller 72, and instructs the drive waveform data generation processor 107 to generate a drive waveform for ink ejection. Furthermore, a report indicating the piezoelectric element which drives the pressure chamber 52 for which an ejection failure determination operation is to be performed, as specified by the dot data generation processor 108 (described hereinafter), is sent by the head controller 106 to the ejection failure determination controller 109 (described hereinafter), and modification of the generated dots is instructed by the head controller 106 on the basis of ejection failure information received from the ejection failure determination controller 109.

The drive waveform data generation processor 107 generates drive waveforms for driving the ejection piezoelectric elements 58 in order to generate dots of respective sizes, determine ejection failures, perform maintenance operations, and prevent evaporation of ink at the nozzle surface, in accordance with the instructions from the head controller 106, as well as the temperature and humidity conditions, and the media conditions, and the like. This drive waveform data is stored in the RAM 115. The drive waveform data stored in the RAM 115 is converted from digital to analog in accordance with a prescribed clock signal, and then is amplified to a prescribed voltage by a drive amplifier 116, whereupon the signal is switched by the switch circuit 114 and supplied to the ejection piezoelectric element 58 of the pressure chamber 52 which is to be driven.

Here, an ejection failure determination waveform is a waveform whereby the ejection piezoelectric element 58 of each pressure chamber 52 is driven at or below the drive condition for normal ejection, in order to determine an ejection failure, separately from normal ink ejection. The ejection failure is determined by determining the consequent ink pressure by means of the bar-shaped sensor 104. As described in more detail below, the ejection failure determination waveform is a waveform suitable for determining ejection failures, which does not produce an ink ejection operation. Desirably, the ejection failure determination waveform should be a waveform that is different to the drive waveform applied when ink is ejected, and one suitable example of a waveform of this kind is a sinusoidal waveform having a frequency which resonates with the size of air bubbles that have a high probability of entering into the pressure chamber 52 and affecting ejection. Alternatively, the ejection failure determination waveform may be added to a step-shaped or impulse-shaped waveform, in such a manner that the response of the whole pressure chamber 52 can be seen.

The dot data generation processor 108 generates dot arrangement information from text and/or image information, in accordance with instructions from the head controller 106. The dot data thus generated is accumulated in the RAM 117. By performing parallel to serial conversion, the dot data accumulated in the RAM 117 is supplied to the vicinity of the drive elements by means of a small number of signal wires. Furthermore, in accordance with the prescribed clock signal, the switching circuit 114 is switched by the drive multiplexer logic unit 113 in synchronism with the waveform data, in such a manner that the drive waveform is sent to the ejection piezoelectric elements 58 of the respective pressure chambers 52.

The dot data generation processor 108 decides the ejection piezoelectric elements 58 of the pressure chambers 52 at which the ejection failure determination operation is to be performed on the basis of the information relating to the dot arrangement (the information relating to the operational states of the ejection piezoelectric elements 58 of the respective pressure chambers 52), reports it to the head controller 106, and furthermore creates a dot that is not ejected and corresponds to the ejection failure determination waveform generated by the drive waveform data generation processor 107.

The ejection failure determination controller 109 sends a report to the head controller 106 when the ejection failure is determined during the performance of the ejection failure determination operation on the basis of an instruction from the system controller 72 and information from the head controller 106 as to the ejection piezoelectric elements 58 of the pressure chambers 52 with which the ejection failure determination operation is to be performed.

FIG. 15 shows three rows of the pressure chambers 52, each row having the five pressure chambers 52, but the common bar-shaped sensors 104 (104-1, 104-2, 104-3) which pass through the plurality of pressure chambers 52 arranged in each row (in FIG. 15, the five pressure chambers 52 in each row) are provided as pressure determination devices corresponding to the pressure chambers 52. By switching the switch circuit 112 by the determination multiplexer logic unit 111 controlled by the ejection failure determination controller 109, the outputs from these bar-shaped sensors 104 are successively voltage-converted and amplified. Subsequently, the low-frequency noise component is removed by a band-pass filter (BPF), unwanted high-frequency components tuned with the analog-to-digital conversion sampling frequency are removed, and the signals are then converted from analog to digital and stored in the memory (RAM) 118.

The ejection failure data processor 110 processes the data accumulated in the memory 118 and judges whether there is a state which is giving rise the ejection failure or not. Consequently, if a pressure chamber 52 or an ejection piezoelectric element 58 that is in a state that is giving rise to the ejection failure is discovered, then this result is transmitted to the ejection failure determination controller 109.

In the present embodiment, in order to improve the accuracy of ejection failure determination including ejection defects, such as irregular droplet size or deflection of the droplet flight direction, the ejection failure determination is carried out in a state of reduced ejection force so that the ejection force is below the design margin where the ejection is achieved provided that there is no abnormality such as the occurrence of air bubbles, blocking of the nozzles, increased ink viscosity, or the like. This is described below.

Here, desirably, "a state of reduced ejection force" is achieved by using a method in which the drive voltage of the actuator is reduced, or by a method where the rise and fall of the drive voltage waveform is smoothed and gentle. The method where the drive voltage is reduced is especially desirable because the ejection force is controllable continuously and stably.

On the other hand, in the case of a pulse-shaped drive waveform, changing the pulse width is not very desirable, because, especially in the case of a piezo-type actuator, changing the pulse width cause the nozzle, pressure chamber, ink supply system, and piezo actuator to deviate from the established resonance point based on the ink properties, and the desired beneficial effects are not readily obtained.

Furthermore, although either the piezo method or the thermal method can be used for the actuators of the pressure chambers, the following four design conditions must be taken into account in relation to the drive conditions, such as the drive force, the drive frequency, the rise of the drive pulse, and so on.

Figure 16:
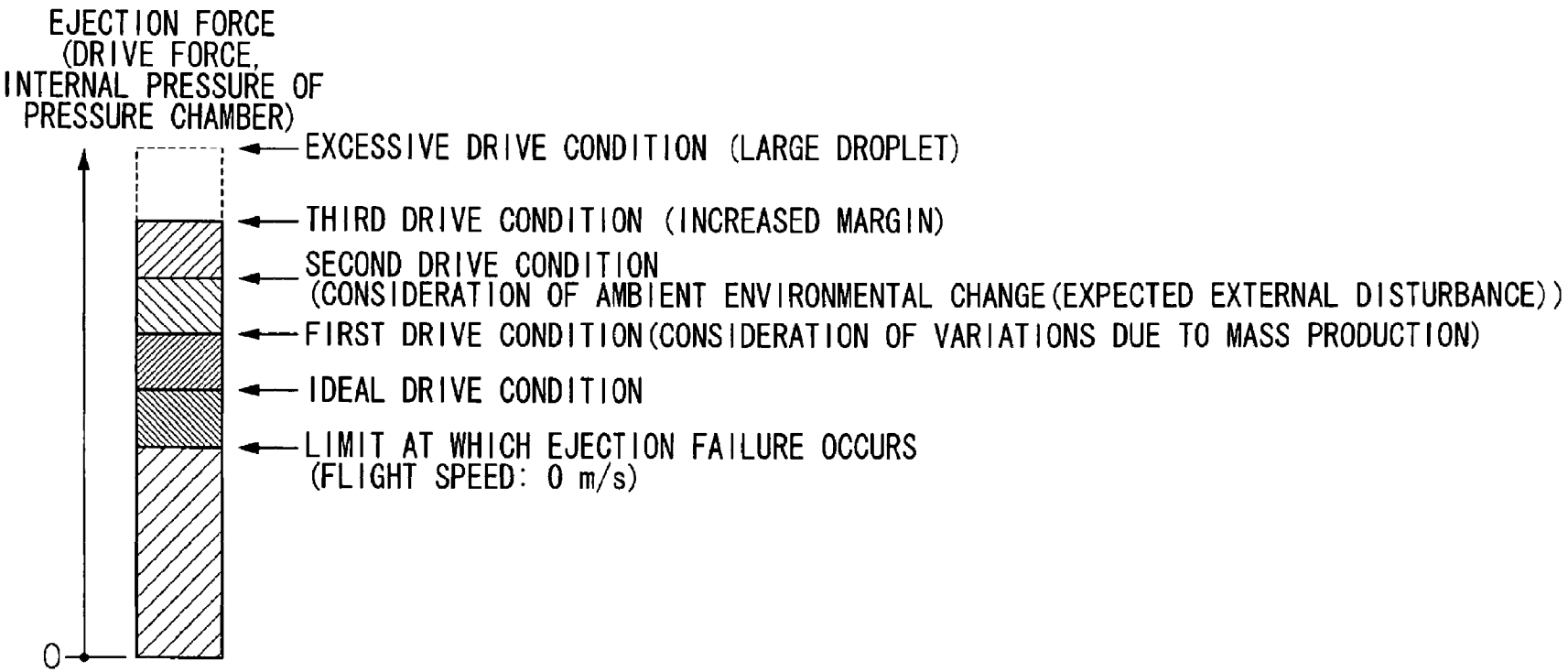
FIG. 16 is an illustrative diagram showing a schematic view of the relationship between drive conditions and the ejection force.

FIG. 16 is a schematic illustration of the relationship between various drive conditions and the ejection force (drive force, or pressure inside the pressure chamber).

In FIG. 16, the ejection force is indicated on the vertical axis, and the respective drive conditions are listed vertically on the right-hand side thereof, in accordance with the ejection force. However, the position of each drive condition in the vertical direction does not accurately represent the ejection force relating to that condition; rather, the drawing provides a schematic representation of the relationships between the respective drive conditions, on the basis of their vertical order.

In FIG. 16, the "limit at which the ejection failure occurs" listed on the bottom relates to cases where the drive voltage gradually declines when a certain drive waveform is applied to the print head, and when it reaches a certain voltage, the ink flight speed becomes 0 m/s and no ink is ejected. In other words, the "limit at which the ejection failure occurs" corresponds to the occurrence of that ejection failure.

Furthermore, the "ideal drive condition" listed above this is the ideal drive condition (for normal ejection) at the mid-point of the design specifications when the dimensions and properties of the various sections of the print head conform to the design values; for example, it is a drive condition which causes ink to be ejected and flying at a speed of approximately 10 m/s to 15 m/s.

Furthermore, the "first drive condition" listed above "the ideal drive condition" indicates a drive condition in which a larger drive force is produced than the force at the mid-point of the design specifications, which indicate the ideal drive condition, by taking account of individual performance variations in such a manner that ink ejection is barely possible even if there is a prescribed variation (of $3\sigma$ to $6\sigma$) in the dimensions and characteristics of the various sections of the head as a result of mass production.

Furthermore, the "second drive condition" listed above that is a drive condition which also takes account of expected external disturbances, in such a manner that a drive force is produced, which is larger than that of the first drive condition which takes account of the individual performance variations to ensure that ejection is barely possible even in cases where the expected external disturbances, such as change in the ambient temperature, humidity change, atmospheric pressure change, variation in the ink properties, and the like, have occurred in the first drive condition.

Furthermore, the "third drive condition" listed above that is a drive condition that also takes account of so-called unexpected external disturbances and provides a further margin with respect to the second drive condition in order that at least a uniform speed of flight is achieved.

Moreover, if the drive force is increased further beyond this, then an excessive drive condition is reached and the size of the ejection droplets becomes large. Therefore, the drive condition used when ink ejection is performed actually is the second drive condition, the third drive condition, or a drive condition between these two conditions.

Figure 17A:
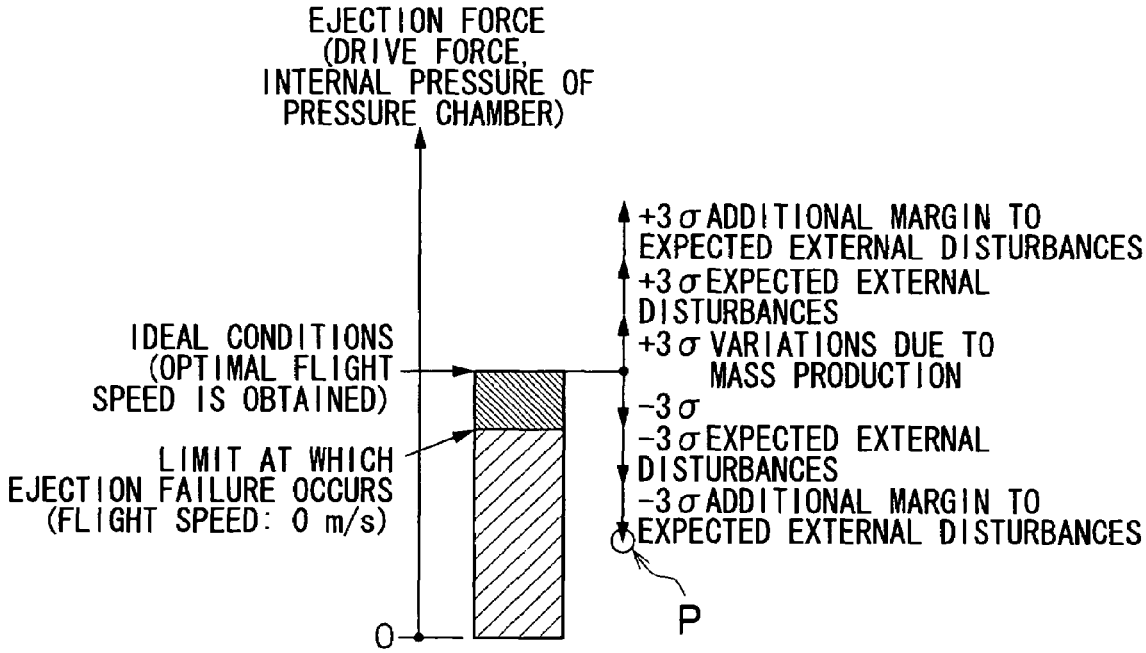
FIGS. 17A and 17B are illustrative diagrams showing steps for obtaining the relationship in FIG. 16.

The reason why the four drive conditions such as those shown in FIG. 16 is considered in designing the drive conditions (namely, the ideal drive condition and the first to third drive conditions), is that it is preferable that the ink be ejected by the smallest possible drive force as shown in FIG. 17A, for example, and a suitable flight speed should be obtained provided that ejection is driven at the ideal drive condition which is slightly higher than the limit at which the ejection failure occurs. However, in an actual apparatus, there is some decline of the drive force caused by individual performance variations, expected external disturbances, unexpected external disturbances, and so on.

In this way, there are variations and external disturbances that must be taken into account in relation to the ideal conditions, and if these factors are respectively represented as $3\sigma$, then in the worst case scenario, the drive force will fall to the level indicated by P and ejection may not be possible.

Figure 17B:
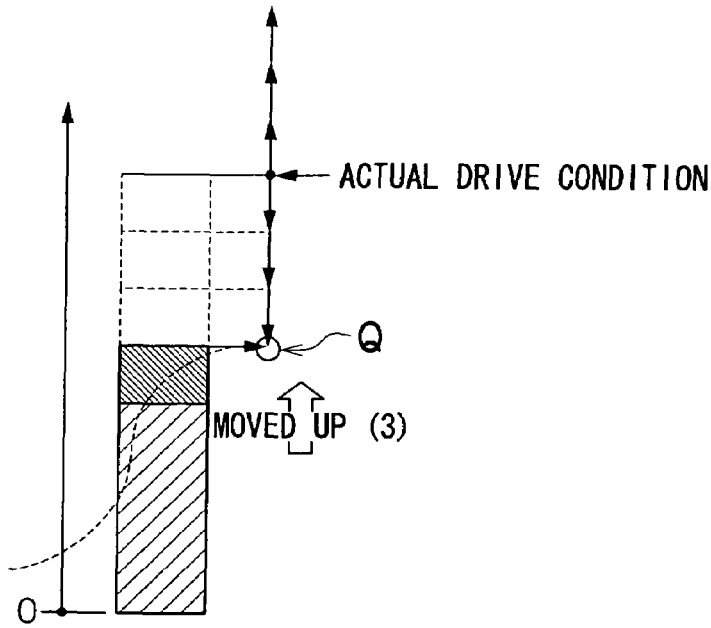

Therefore, as shown in FIG. 17B, the drive force is raised slightly in order that the ejection is at least possible even in the worst scenario indicated by P, and hence P is shifted to the position Q indicating the ideal conditions. In this case, the ideal conditions indicated by FIG. 17A are raised to the actual drive conditions shown in FIG. 17B. In this way, the schematic drawing of the drive conditions shown in FIG. 16 mentioned above is obtained.

Next, the individual performance variations mentioned above will be described.

Figure 18A:
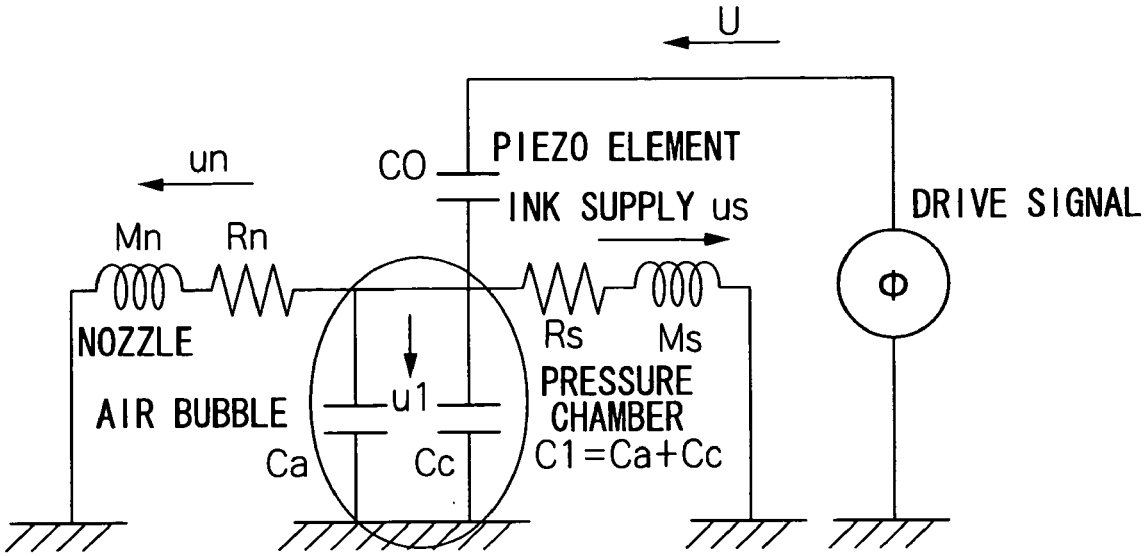
FIG. 18A is an electrical circuit providing a model of an inkjet head.

FIG. 18A is a model in which the print head 50 of the inkjet recording apparatus 10 is rewritten as an electrical circuit. As shown in FIG. 18A, the piezo element (piezoelectric element) 58 is represented by a capacitance C0, the pressure chamber 52 is represented by a capacitance Cc, and the air bubbles which may cause ejection failures are represented by a capacitance Ca. Furthermore, the thin flow channels through which the ink passes, such as the ink supply port 53 and the nozzle 51, are represented respectively by coils Ms and Mn, and resistances Rs and Rn.

Figure 18B:
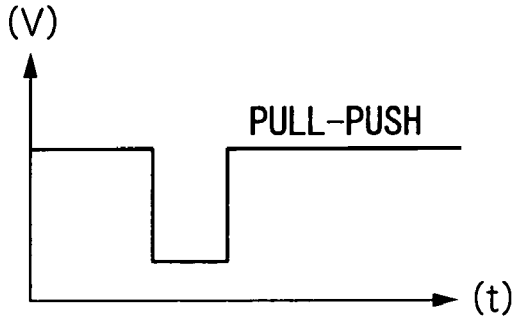
FIGS. 18B and 18C are graphs showing examples of drive waveforms.
Figure 18C:
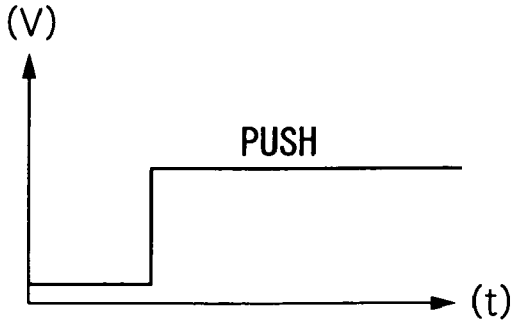

Furthermore, in FIG. 18A, $\phi$ is the drive signal (drive energy), which is represented by voltage in the circuit, but in an actual device, it corresponds to the input pressure applied to the pressure chamber. Moreover, u, un, us and u1 represent the current flowing in the respective sections of the circuit, but in an actual device, u corresponds to the time differential of the displacement volume of the piezo element, and un and us correspond to the displacement volumes of the ink toward the nozzle side and the ink supply side, respectively. Additionally, u1 corresponds to the ink volume velocity corresponding to the ink flow due to the volume compression of the air in the pressure chamber and the air bubbles. Furthermore, FIGS. 18B and 18C indicate drive signals; FIG. 18B shows a pull-push operation for driving ejection and FIG. 18C shows a push-only operation.

A model calculation is performed to establish the speed at which ink is ejected when the drive signal of this kind is applied. The calculational formula corresponding to the system shown in FIG. 18A is given in the following formula (1):

$$\left.\begin{aligned} \phi &= \frac{1}{C0}\int U dt + \frac{1}{Ca+Cc}\int u1 dt \\ 0 &= R\cdot u2 + M\frac{du2}{dt} \end{aligned}\right\} \quad (1)$$

where $u2 = un + us;$ $$R = \frac{Rn\cdot Rs}{Rn+Rs} = \frac{Rn}{1+\frac{Rn}{Rs}} = \frac{Rn}{1+\frac{1}{k}}; \quad and$$

$$M = \frac{Mn\cdot Ms}{Mn+Ms} = \frac{Mn}{1+\frac{1}{k}}.$$

Here the resistance and inertance of the nozzle and ink supply have a ratio of 1:k. Moreover, the resistance and inertance of the pressure chamber can be ignored in comparison with the aforementioned values (in fact, it is some 2 to 3 powers of ten smaller).

The formula (1) is simultaneous differential equations which express the general relationship among the drive signal ϕ, the capacitance C0, the current u (rate of displacement volume of piezo element), the capacitances Ca and Cc, and the current u1 (the change in the volume of the pressure chambers and air bubbles). Furthermore, this simultaneous differential equation can be solved analytically by a Laplace transformation method, if ϕ is taken to be a step function, and therefore, the state of the system from the initial point of application of the signal until any given time point t can be determined.

By solving the above formula (1), it is possible to identify the speed at which the ink is propelled and flying in a case where there are air bubbles under certain conditions.

In this, in practice, the calculation is made by inserting the design values of the head and the values of the ink properties such as those given in Table 1 in FIG. 19, for example, into the simulation model shown in FIG. 18A.

The results of the calculation are shown in Table 2 in FIG. 20.

Table 2 lists various calculation conditions, and indicates in respect of each of these conditions, the resonant frequency (period of resonance) of the head and the maximum value of the flow speed in the nozzle, as well as showing these figures as a rate of change indicating the change in these figures with respect to the mid-point of the design specifications, which indicate a normal state.

The standard conditions shown in the uppermost row of the calculation conditions in Table 2 indicate the calculation result in an ideal state where there is absolutely no error. For example, in this case, the flow speed in the nozzle is 11.5 m/s, ink is propelled and flying in a sufficiently stable manner, provided that the speed is in this region. The rows below this indicate results that are led on the basis of a 10% increase in the ink viscosity, a 5% increase in the nozzle diameter, a 10% increase in the nozzle length, a 10% increase in the pressure chamber volume, a 10% decrease in the actuator capacity, and a combination of all of these variations. In these cases, the change in the flow speed in the nozzle is 0.788, which means the speed falls to 78.8%.

Furthermore, the row below this shows the results in a case where there is an air bubble of 10 μm diameter, and here, the change in the flow speed in the nozzle is 0.964, which means that the flow speed in the nozzle falls by some 4%. Moreover, the root-sum-square of these five variation factors is 0.874, which indicates a decline of approximately 13% in ejection performance. This decline of approximately 13% corresponds to the decline in drive force resulting from individual performance variations between the first drive condition and the ideal drive condition shown in FIG. 16 above.

Figure 21A:
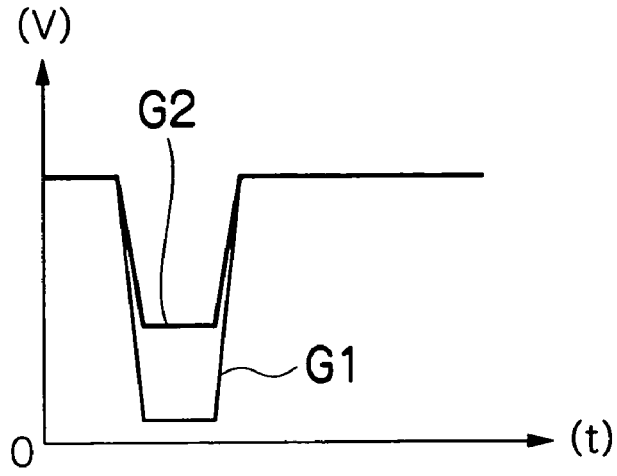
FIGS. 21A to 21C are graphs showing input waveforms and determination waveforms.
Figure 21B:
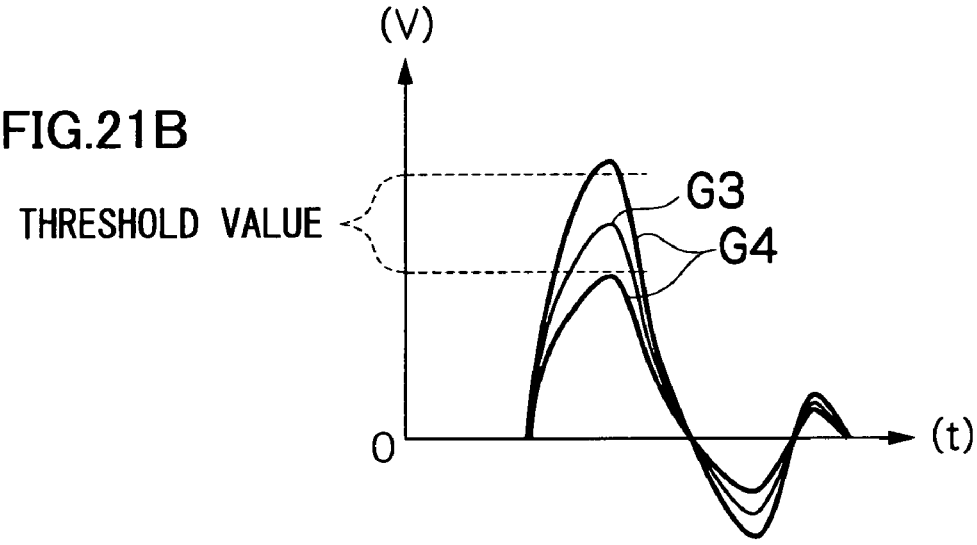
Figure 21C:
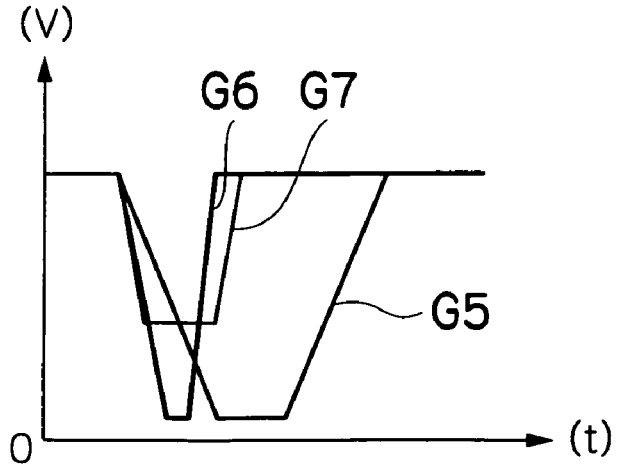

FIGS. 21A to 21C show examples of drive waveforms and determination waveforms in a case where ejection failure determination is performed by reducing the drive force to be smaller than the force employed when ink is actually ejected.

FIG. 21A shows examples of input drive waveforms, which fall from a prescribed voltage and then rises up again. The waveform G1 indicated by the thin line is an ejection waveform in normal circumstances when ink is actually ejected; and in this case, the piezo element undergoes a large deformation and causes ink to be ejected. On the other hand, the waveform G2 indicated by the thick line is a waveform used when ejection failure determination is performed, and the fall in this waveform is less than that in the ejection waveform G1.

FIG. 21B shows examples of determination waveforms, which are obtained by measuring the ink pressure inside the pressure chamber 52 by means of a pressure sensor 93 or bar-shaped sensor 104 as described above. In FIG. 21B, the waveform G3 indicated by the thin line shows a normal case, and the waveforms G4 indicated by the thick lines show abnormal cases. In the abnormal case, as indicated in FIG. 21B, values which are extremely high or low and which exceed previously established threshold values, are determined.

Furthermore, the diagram shown in FIG. 21C gives further examples of input waveforms. In FIG. 21C, the waveform G5 indicated by the thick line has a less steep rise and fall waveform, and the length of the flat part of the trough portion is the same as the waveform G1 in FIG. 21A. Although the amplitude of the voltage is approximately the same as the waveform G1, ejection performance is reduced because the rise and fall are slowed.

Although the rise and fall of the waveform G6 indicated by the thick line in FIG. 21C is approximately the same as that of the waveform G1, the time period of the trough portion is shorter and the pulse width is smaller. Therefore, the waveform diverges from the resonant frequency for ejecting ink and hence ink cannot be ejected very successfully in this state.

Moreover, the waveform G7 of the thin line in FIG. 21C is the same as the waveform G2 for determination shown in FIG. 21A, and it is illustrated for the purposes of comparison.

In the print head 50 according to the present embodiment, a piezo-type actuator is used. In this case, the actuator is displaced, pressure is generated, and the liquid is ejected. Therefore, the pulse width is not related to the generated displacement or the magnitude of the pressure. In practice, the coefficient C0 indicating the properties of the actuator in the aforementioned equation (1) satisfy the following relation:

C0=(volume removed by displacement)/(generated pressure).

The pulse has a rise portion and a fall portion. The actuator is displaced in a prescribed direction in the rise portion, maintains that displacement while the pulse voltage remains uniform, is displaced in the opposite direction in the fall portion and thus returns to the initial state. By means of the stage of displacement in the prescribed direction and the stage of displacement in the opposite direction, energy is transmitted to the liquid and this forms a performance to eject the liquid.

In this case, the inkjet head using piezo type actuators forms an oscillatory system based on fluid elements. Therefore, the behavior of the system changes completely depending on the timing at which the energy is applied to the oscillatory system.

Figure 22:
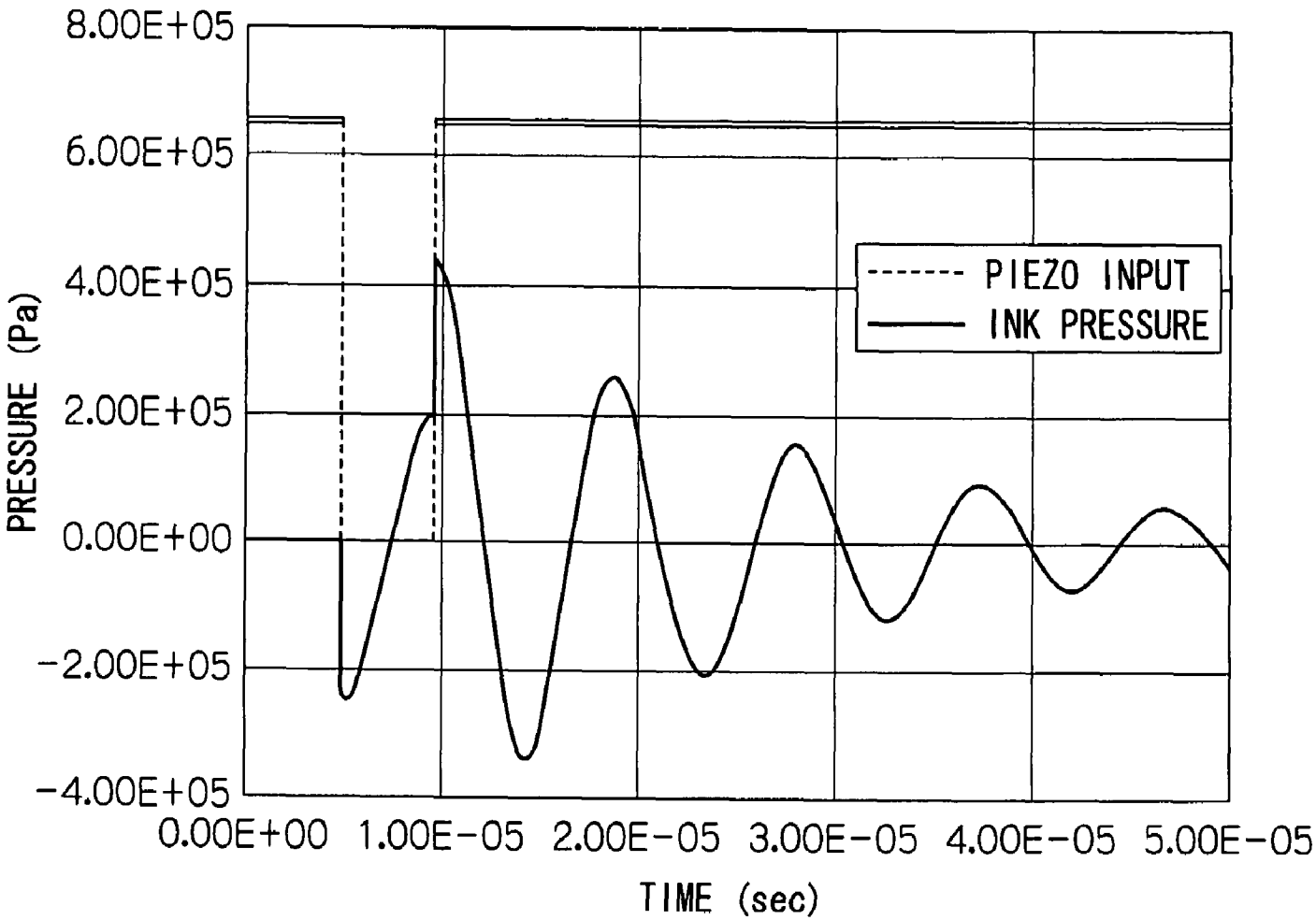
FIG. 22 is a graph showing the dynamic response of an inkjet head according to the conditions indicated in Table 1, when an input having a pulse width of ½ of the resonant frequency is supplied.

FIG. 22 shows the dynamic response of the head based on the conditions shown in Table 1. In this example, a greater response is obtained by supplying an input having a pulse width of one-half of the resonant frequency of the inkjet head. Although this case relates to the ink pressure, the ink speed is approximately proportional to this pressure.

Figure 23:
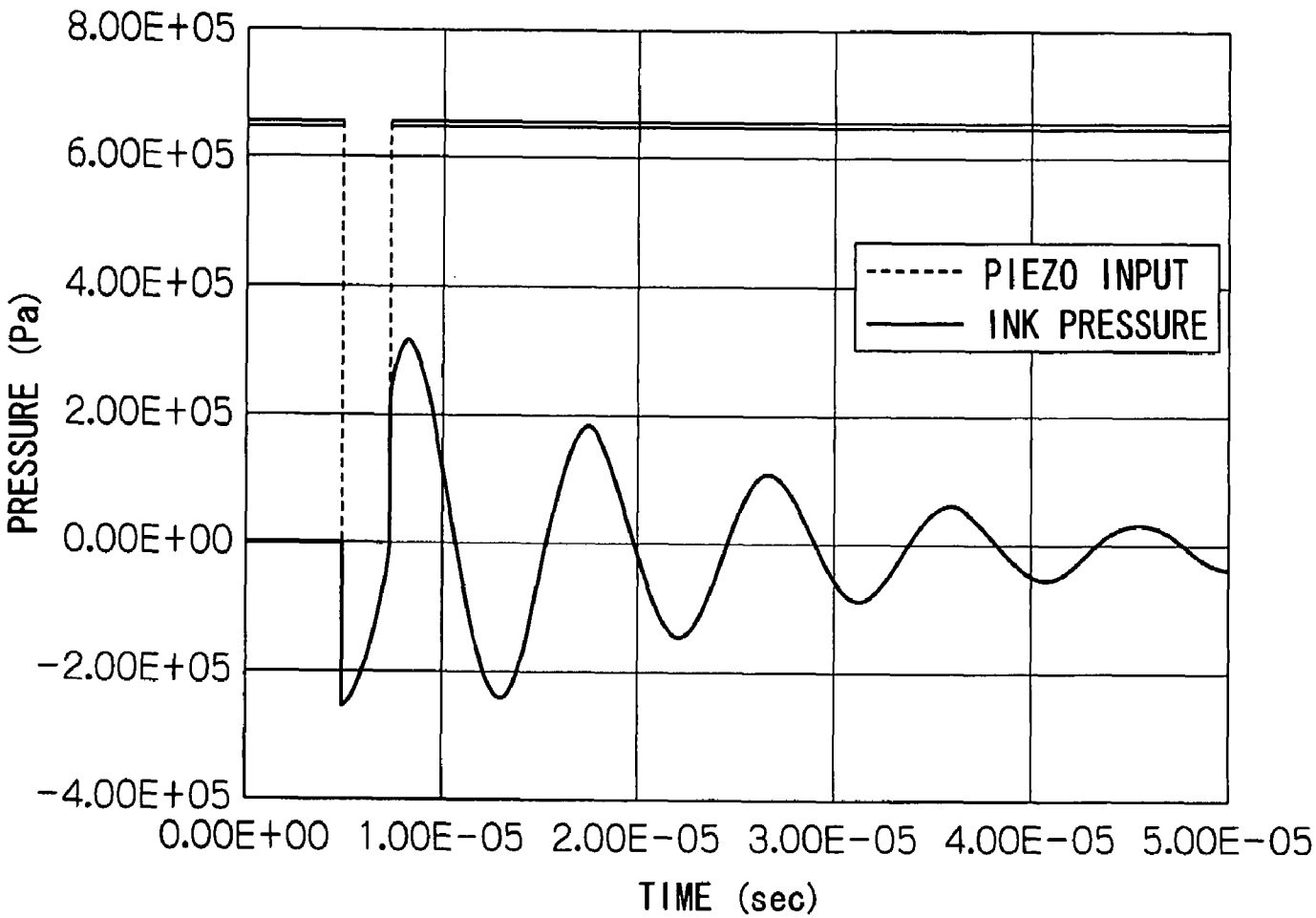
FIG. 23 is a graph showing the response of the same head as FIG. 22 in a case where an input having a pulse width of ¼ of the resonant frequency is supplied.

Furthermore, FIG. 23 shows the response in a case where an input having a pulse width of ¼ of the resonant frequency is supplied to the same print head. In this example, the response is smaller than that in the example shown in FIG. 22. In the two examples described above, the shortening of the pulse width reduces the ejection capacity.

Figure 24:
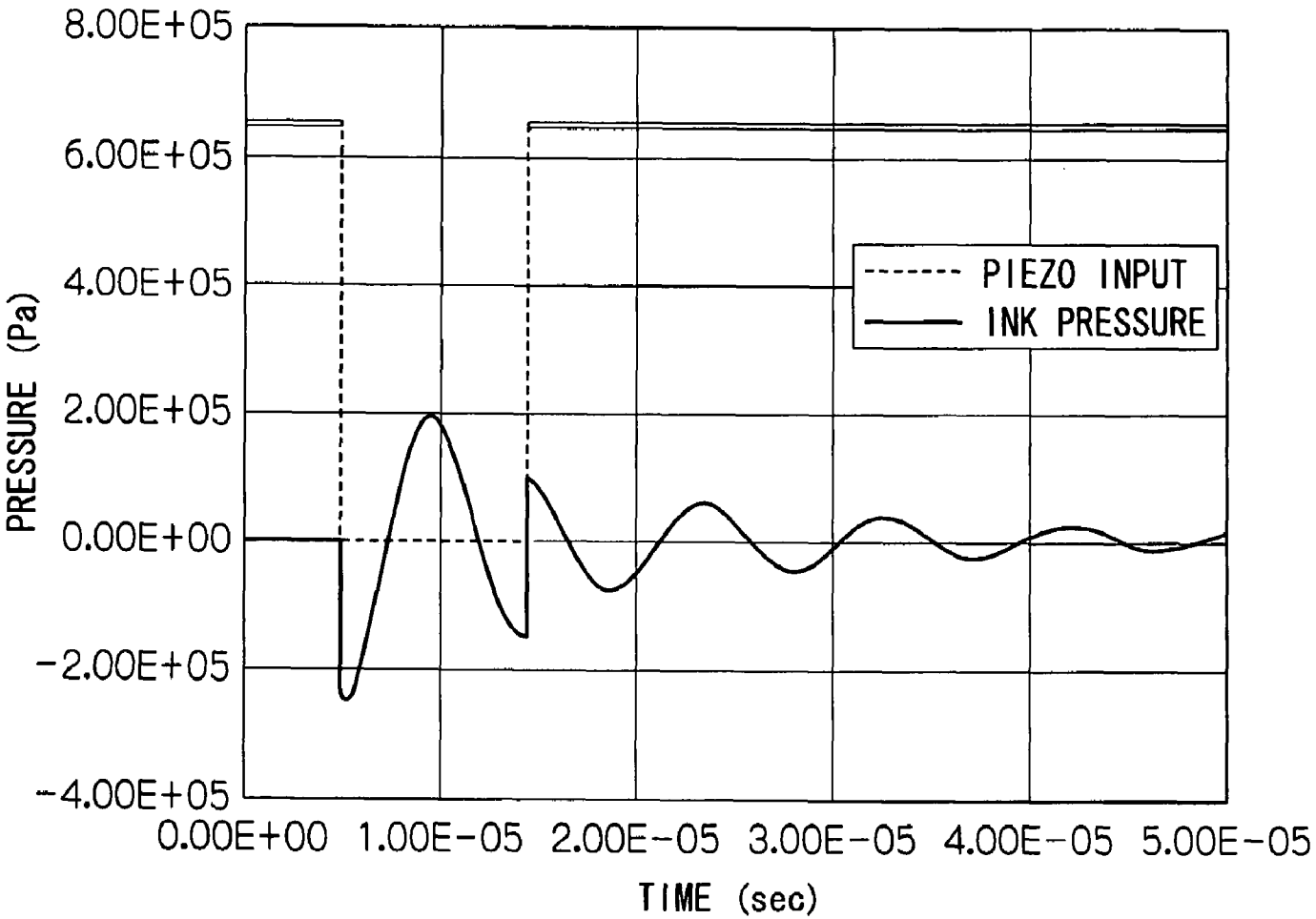
FIG. 24 is a graph showing the response of the same head as FIG. 22 in a case where an input having a pulse width equal to the resonant frequency is supplied.

The next diagram, FIG. 24, shows the response in a case where an input having a pulse width equal to the resonant frequency is supplied to the print head (in other words, the pulse width is lengthened). In this case also, the response is smaller than that of the example shown in FIG. 22, and it is even smaller than that of the example shown in FIG. 23. In other words, in the piezo-type actuator, the relationship between the pulse width and the resonant frequency of the system is significant, and lowering the ejection capacity is not simply a matter of shortening the pulse width.

As described previously, in terms of the actual printing drive conditions, printing is performed by using either the second drive condition shown in FIG. 16, or the third drive condition that allows an additional margin with respect to the second drive condition. The ejection failures are determined under drive conditions that are reduced from these conditions.

The main causes behind the ejection failures are thought to be the following.

The principal causes of ejection failures are as follows: a case where an air bubble becomes mixed into the pressure chamber 52 or the like; a case where the ink viscosity increases due to the evaporation of the ink solvent; a case where the resistance has increased; a case where the ink solvent has evaporated further and a nozzle blockage has occurred due to solidification of the ink; a case where foreign matter has become caught in the ink flow channel or nozzle; a case where the nozzle surface has become soiled due to minute ink satellites, or the like; or a case where there is wearing of the liquid repelling treatment on the nozzle surface, or a fault in the actuator, or a fault such as peeling apart of the structural members of the head.

The actual printing drive conditions used are the second drive condition shown in FIG. 16 or the third drive condition, which allows a greater margin with respect to the second drive condition. Thus, in determining ejection failures, there exist the following two determination conditions corresponding to these conditions.

Firstly, in the case of determination condition (a), if the actual printing drive condition is the second drive condition in FIG. 16, then ejection failures in the pressure chambers 52 are determined under the first drive condition shown in FIG. 16 or in a condition in which the drive force is equal to or less than that of the first drive condition. In other words, the second drive condition involves an increased drive force that takes account of expected external disturbances, with respect to the first drive condition, but the ejection failure determination is carried out under a drive condition in which at least this increase in drive force is subtracted.

Next, in the case of determination condition (b), if the actual printing drive condition is the third drive condition in FIG. 16, then ejection failures in the pressure chambers 52 are determined under the second drive condition shown in FIG. 16 or in a condition in which the drive force is equal to or less than that of the second drive condition. In other words, although the third drive condition includes an additional margin with respect to the second drive condition, the determination is carried out under a drive condition in which at least this margin is subtracted.

In the case of an apparatus in which the drive condition can be adjusted for each actuator (piezoelectric element 58 ) at each nozzle 51, ultimately, the first drive condition is corrected for variation between the nozzles 51. Therefore, the spare margin of drive force contemplated with respect to the first drive condition can be set to zero.

Furthermore, the determination is carried out under the determination condition (a) or the determination condition (b) in accordance with the actual printing drive condition. If the determination is performed on the basis of determination condition (b) and ejection failures are determined after the drive condition is reduced from the third drive condition to the second drive condition, then the drive condition may be reduced further to the first drive condition (or below) in such a manner that the determination is carried out by using both condition (a) and condition (b). -Furthermore, although the drive condition is set to the first drive condition or a condition equal to or less than the first drive condition in the determination condition (a), it is desirable that the determination be carried out at the first drive condition. Moreover, although the drive condition is set to the second drive condition or a condition equal to or less than the second drive condition in the determination condition (b), it is desirable that determination be carried out at the second drive condition.

Furthermore, in a printer in which the switch between the above two determination methods (a) and (b) is performed and the ejection conditions are changed, it is desirable that the conditions for determining ejection failures should be switched accordingly. A printer of this kind is, for example, a printer in which more energy-saving drive conditions, or more stable drive conditions can be selected according to environmental changes in the temperature, printing speed, and the like. The printing speed is given as an example here because when printing is achieved at high speed, there is consequently much greater demand on the ink supply, and ejection failures are liable to occur due to failure of the ink supply to meet the demand.

The selection of drive conditions and switching between conditions is performed by the print controller 80 described above (see FIG. 6) via the head driver 84.

The conditions for ejection failure determination according to the present embodiment define the optimal drive conditions for the determination, rather than simply carrying out the determination by reducing the drive force. More specifically, it is possible to determine states which barely avoid leading to ejection failure in normal ejection, but which are precursors of ejection failures, such as the start of an increase in the ink viscosity due to evaporation of the solvent, increase in the ink viscosity due to local temperature variations in the head, infiltration of small air bubbles which are not sufficient to produce ejection failure into the pressure chambers, and the like. Therefore, problems can be prevented in advance.

Furthermore, as a method for determining the ejection failure, as described above, it is possible to use the external determination method, such as monitoring the flight of the ink optically, printing a special pattern for the determination or reading and determining the actual print image, or ejecting charged ink, receiving the ink on an electrode and measuring the change in the electrostatic capacitance. It is also possible to use an internal determination method in which a special drive signal for the determination is applied successively to the pressure chambers under inspection, during a printing operation and the ejection failures are determined by observing the response of the internal pressure. In the case of the internal determination method, the drive conditions described above are used as the special drive signal for determination.

Furthermore, in the case of internal determination, as a device for determining the pressure, it is suitable to use the flat plate-shaped pressure sensor 93, or the bar-shaped sensor 104, as described above. If the internal determination is used, then the determination accuracy can be improved, since the action of actually ejecting ink from a nozzle capable of ejection produces large changes in the physical quantities.

More specifically, even in the case where the internal determination is used, under the drive conditions for determination according to the present embodiment, ink is ejected from normal pressure chambers and ink is not ejected from pressure chambers which are suffering a problem (in other words, the ink that should have been ejected returns back into the nozzle or pressure chamber). Therefore, compared to a method where internal determination is performed under a drive condition set in such a manner that ink is not ejected, a relatively large difference arises in the physical phenomena that whether ink is ejected in a normal state or problem state or not. Hence, a large difference is produced in the determination signals from the sensor.

Furthermore, under the drive condition during the determination according to the present embodiment, ink is ejected from normal pressure chambers, and therefore, this determination can be carried out during normal image printing. In other words, if the drive condition is set to a condition for the determination, and the determination timing is matched to the image that is to be printed, then the ejected ink volume is somewhat reduced, but it is possible to print an image by ejecting ink at the timings required actually for image printing.

In general, since the number of pressure chambers suffering a problem is much smaller than the number of normal pressure chambers, it is possible to prevent missing pixels, or to make the ejection failures less conspicuous. Moreover, even when there is a problematic pressure chamber, if the ejection failures are detected by the above-mentioned method, then it is possible to prevent missing pixels or to make the ejection failures less conspicuous by means of the following methods: a method of increasing the ejection from the pressure chambers within the length of missing pixels that is allowable in terms of the image, a method of changing the ejection (arrangement) and making of the peripheral pixels, or a method of changing the ejected ink volume for forming the peripheral pixels.

Furthermore, when ejection failures are detected during normal image printing under the drive condition for the determination according to the present embodiment, if the image is not one in which ink is to be ejected soon from a nozzle that is to be investigated, then the nozzle can be investigated by ejecting ink for investigation onto a portion of the image (the recording medium) where it is not actually necessary to eject a droplet by such the nozzle but the ejection of one or so ink droplets will not be conspicuous or a high-density image portion, such as one containing black ink, or the like. This method is particularly effective when an ink of low density is used, such as a light cyan ink, light magenta ink, or yellow ink.

If it is detected that there is an ejection failure or a high risk of same, by carrying out ejection failure determination under the determination condition (a) or the determination condition (b), then a prescribed operation is carried out.

This prescribed operation may be, for example, increasing the drive voltage, controlling the ink temperature, performing a maintenance operation, or the like.

Raising the drive voltage increases the ejection performance, so that ejection is possible even in states where ejection is somewhat difficult to perform due to a cause such as infiltration of minute gas bubbles, or the like.

Furthermore, controlling the ink temperature means setting the ink temperature to a higher temperature than the standard temperature, thereby lowering the ink viscosity, reducing the ejection resistance, and thus making ejection easier to perform. This may be carried out for each pressure chamber respectively, or for the whole print head. Alternatively, it may be performed locally with respect to several points peripheral to the pressure chamber of which temperature is to be controlled, or with respect to the peripheral region thereof.

These two operations are particularly desirable in cases where, for instance, the determination result is satisfactory under the determination condition (b) and the determination result is unsatisfactory under the determination condition (a), and hence the situation is not completely bad, but there is a little possible of a problem arising. Consequently, even in a printer having a head that spans the width of the print medium, it is possible to continue operation without interrupting printing tasks.

Furthermore, the probability of ejection failures can be clear. Hence, if the probability of an ejection failure is relatively low, dots are formed by ejecting ink droplets from the original nozzle on the basis of the method described above. If the probability of an ejection failure is relatively high, then the operation of the original nozzle is halted, and by increasing the volume of ink ejected from the adjacent nozzles, the printing defects caused by the lack of ejection from the original nozzle are made less conspicuous. In this way, more desirable control can be achieved.

Below, a restoration operation will be described.

If the determination result under the determination condition (b) is judged to be satisfactory but the determination result under the determination condition (a) is judged to be unsatisfactory, then since the symptoms are relatively light, a restoration operation (maintenance) which consumes a relatively small quantity of ink and requires a short time, such as purging, is carried out in order to discard the ink in the vicinity of the nozzles.

Furthermore, if the determination result under the determination condition (b) is judged to be unsatisfactory, then the symptoms are medium to serious. Therefore, a restoration operation based on pumping is carried out in order to suction the ink with a pump and discard the ink together with the air bubbles, and the like. This restoration operation consumes a relatively large amount of ink and requires a long time, but on the other hand, it enables ejection failures to be restored securely and reliably.

In this way, according to the present embodiment, ejection failure determination is carried out in a state where the ejection force is reduced to be below the design margin for performing ejection provided that there are no abnormalities, such as air bubbles, nozzle blockages, or the like. In particular, when the determination is performed, the head is driven under drive conditions that are optimal for the determination purposes, in terms of identifying whether an ejection failure will occur or not. Accordingly, states which barely avoid leading to an ejection failure during normal ejection, but which includes precursors of an ejection failure, can be determined, and hence the accuracy of ejection failure determination can be improved.

Moreover, highly efficient maintenance work can be implemented in conformity with the results of the ejection failure determination process.

The liquid droplet ejection apparatus and method for restoring a liquid droplet ejection head according to the present invention have been described in detail above, but the present invention is not limited to the aforementioned embodiments, and it is of course possible for improvements or modifications of various kinds to be implemented, within a range which does not deviate from the essence of the present invention.

What is claimed is:

1. A liquid ejection apparatus, comprising:

a liquid ejection head including an ejection port surface on which a plurality of ejection ports for ejecting a liquid toward a recording medium are arranged;

an ambient environment change measurement device which measures an ambient environmental change;

a drive condition selection device which selects at least one of drive conditions for the liquid ejection head in order to eject the liquid from the ejection ports in accordance with an ejection state of the liquid ejection head and the ambient environmental change, the drive conditions including a first drive condition in which a first drive force is produced while taking account of individual performance variations among the liquid ejection heads in relation to ejection performance, and a second drive condition in which a second drive force is produced while taking account of an expected external disturbance caused on the first drive condition by the ambient environmental change, the first drive force being larger than an ideal drive force produced in an ideal drive condition in which dimensions and properties of sections of the liquid ejection head conform to design values, the second drive force being larger than the first drive force; and an ejection failure determination device which performs determination of the ejection state of the liquid ejection head, wherein, while performing a normal printing operation, if the liquid ejection head is driven under the second drive condition during normal ejection, then the liquid ejection head is driven during the determination of the ejection state with a drive force equal to or smaller than the first drive force.

2. The liquid ejection apparatus as defined in claim 1, further comprising a head restoration device which performs a restoration operation of the liquid ejection head.

3. The liquid ejection apparatus as defined in claim 1, wherein the ejection failure determination device determines pressure of the liquid in the liquid ejection head.

4. The liquid ejection apparatus as defined in claim 1, wherein the ejection failure determination device determines, outside the liquid ejection head, the liquid ejected from the ejection ports.

5. A liquid ejection apparatus, comprising:

a liquid ejection head including an ejection port surface on which a plurality of ejection ports for ejecting a liquid toward a recording medium are arranged;

an ambient environment change measurement device which measures an ambient environmental change;

a drive condition selection device which selects at least one of drive conditions for the liquid ejection head in order to eject the liquid from the ejection ports in accordance with an ejection state of the liquid ejection head and the ambient environmental change, the drive conditions including a first drive condition in which a first drive force is produced while taking account of individual performance variations in relation to ejection performance among the liquid ejection heads, a second drive condition in which a second drive force is produced while taking account of an expected external disturbance caused on the first drive condition by the ambient environmental change, and a third drive condition in which a third drive force is produced, the first drive force being larger than an ideal drive force produced in an ideal drive condition in which dimensions and properties of sections of the liquid ejection head conform to design values, the second drive force being larger than the first drive force, the third drive force being larger than the second drive force; and an ejection failure determination device which performs determination of the ejection state of the liquid ejection head, wherein, while performing a normal printing operation, if the liquid ejection head is driven under the third drive condition during normal ejection, then the liquid ejection head is driven during the determination of the ejection state with a drive force equal to or smaller than the second drive force.

6. The liquid ejection apparatus as defined in claim 5, further comprising a head restoration device which performs a restoration operation of the liquid ejection head.

7. The liquid ejection apparatus as defined in claim 5, wherein the ejection failure determination device determines pressure of the liquid in the liquid ejection head.

8. The liquid ejection apparatus as defined in claim 5, wherein the ejection failure determination device determines, outside the liquid ejection head, the liquid ejected from the ejection ports.

9. A method of restoring a liquid ejection head including an ejection port surface on which a plurality of ejection ports for ejecting a liquid toward a recording medium are arranged, the method comprising the steps of:

measuring an ambient environmental change;

selecting at least one of drive conditions for the liquid ejection head in order to eject the liquid from the ejection ports in accordance with an ejection state of the liquid ejection head and the ambient environmental change, the drive conditions including a first drive condition in which a first drive force is produced while taking account of individual performance variations among the liquid ejection heads in relation to ejection performance, and a second drive condition in which a second drive force is produced while taking account of an expected external disturbance caused on the first drive condition by the ambient environmental change, the first drive force being larger than an ideal drive force produced in an ideal drive condition in which dimensions and properties of sections of the liquid ejection head conform to design values, the second drive force being larger than the first drive force; and performing determination of the ejection state of the liquid ejection head, wherein, while performing a normal printing operation, if the liquid ejection head is driven under the second drive condition during normal ejection, then the liquid ejection head is driven during the determination of the ejection state with a drive force equal to or smaller than the first drive force.

10. The method as defined in claim 9, further comprising the steps of:

performing purging from the ejection ports in the liquid ejection head if a result of the determination of the ejection state under the second drive condition is satisfactory and a result of the determination of the ejection state under the first drive condition is unsatisfactory; and suctioning the liquid from the ejection ports in the liquid ejection head if the result of the determination of the ejection state under the second drive condition is unsatisfactory.

11. A method of restoring a liquid ejection head including an ejection port surface on which a plurality of ejection ports for ejecting a liquid toward a recording medium are arranged, the method comprising the steps of:

measuring an ambient environmental change;

selecting at least one of drive conditions for the liquid ejection head in order to eject the liquid from the ejection ports in accordance with an ejection state of the liquid ejection head and the ambient environmental change, the drive conditions including a first drive condition in which a first drive force is produced while taking account of individual performance variations in relation to ejection performance among the liquid ejection heads, a second drive condition in which a second drive force is produced while taking account of an expected external disturbance caused on the first drive condition by the ambient environmental change, and a third drive condition in which a third drive force is produced, the first drive force being larger than an ideal drive force produced in an ideal drive condition in which dimensions and properties of sections of the liquid ejection head conform to design values, the second drive force being larger than the first drive force, the third drive force being larger than the second drive force; and performing determination of the ejection state of the liquid ejection head, wherein, while performing a normal printing operation, if the liquid ejection head is driven under the third drive condition during normal ejection, then the liquid ejection head is driven during the determination of the ejection state with a drive force equal to or smaller than the second drive force.

12. The method as defined in claim 11, further comprising the steps of:

performing purging from the ejection ports in the liquid ejection head if a result of the determination of the ejection state under the third drive condition is satisfactory and a result of the determination of the ejection state under the second drive condition is unsatisfactory; and suctioning the liquid from the ejection ports in the liquid ejection head if the result of the determination of the ejection state under the third drive condition is unsatisfactory.

* * * * *